US011168927B2

(12) United States Patent
Ishiyama et al.

(10) Patent No.: US 11,168,927 B2
(45) Date of Patent: Nov. 9, 2021

(54) REFRIGERATION CYCLE APPARATUS

(71) Applicant: Mitsubishi Electric Corporation, Tokyo (JP)

(72) Inventors: Hiroki Ishiyama, Tokyo (JP); Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 30 days.

(21) Appl. No.: 16/329,431

(22) PCT Filed: Nov. 25, 2016

(86) PCT No.: PCT/JP2016/085004
§ 371 (c)(1),
(2) Date: Feb. 28, 2019

(87) PCT Pub. No.: WO2018/096655
PCT Pub. Date: May 31, 2018

(65) Prior Publication Data
US 2019/0346188 A1 Nov. 14, 2019

(51) Int. Cl.
*F25B 31/00* (2006.01)
*F25B 13/00* (2006.01)
*F25B 49/02* (2006.01)

(52) U.S. Cl.
CPC ..... *F25B 31/004* (2013.01); *F25B 13/00* (2013.01); *F25B 49/022* (2013.01);
(Continued)

(58) Field of Classification Search
CPC .... F25B 2700/21155; F25B 2700/1932; F25B 2700/03; F25B 2600/00; F25B 2600/022; F25B 2600/026; F25B 2600/0262
See application file for complete search history.

(56) References Cited

U.S. PATENT DOCUMENTS 5,966,947 A * 10/1999 Kamimura ..... F24F 3/065 62/84
2003/0066302 A1* 4/2003 Ueno ..... F25B 5/02 62/192

(Continued)

FOREIGN PATENT DOCUMENTS

EP 1605212 A2 12/2005
JP H4-184048 A 7/1992

(Continued)

OTHER PUBLICATIONS

Extended European Search Report dated Aug. 6, 2019 issued in corresponding EP patent application No. 16922199.1.

(Continued)

*Primary Examiner* — Nelson J Nieves
*Assistant Examiner* — Meraj A Shaikh
(74) *Attorney, Agent, or Firm* — Posz Law Group, PLC

(57) ABSTRACT

A refrigeration cycle apparatus includes a plurality of outdoor units. Each of the plurality of outdoor units includes an outdoor heat exchanger, a compressor, and a sensor to detect the quantity of refrigeration oil in the outdoor unit. A controller has a first operation mode in which a part of the plurality of outdoor units is operated and another outdoor unit is stopped; and a second operation mode in which all of the plurality of outdoor units are operated. In the first operation mode, when the operating time of an operating outdoor unit exceeds a prescribed time and the quantity of refrigeration oil in the compressor of the operating outdoor unit is equal to or larger than a prescribed quantity, the controller stops the operating outdoor unit and makes a switch to bring a stopped outdoor unit of the plurality of outdoor units into operation.

9 Claims, 17 Drawing Sheets

(52) U.S. Cl.
CPC ... *F25B 2313/0253* (2013.01); *F25B 2400/06* (2013.01); *F25B 2500/16* (2013.01); *F25B 2600/01* (2013.01); *F25B 2700/03* (2013.01)

(56) References Cited

U.S. PATENT DOCUMENTS

| | | | | |
|---|---|---|---|---|
| 2016/0123635 | A1* | 5/2016 | Huang | F25B 13/00 62/84 |
| 2016/0201964 | A1* | 7/2016 | Ochiai | F25B 13/00 62/193 |
| 2019/0242622 | A1* | 8/2019 | Matsuda | F25B 43/02 |

FOREIGN PATENT DOCUMENTS

| | | | |
|---|---|---|---|
| JP | H8-200856 | A | 8/1996 |
| JP | 2002-317785 | A | 10/2002 |
| JP | 2003-166740 | A | 6/2003 |
| JP | 2004-069213 | A | 3/2004 |
| JP | 2007-101127 | A | 4/2007 |
| JP | 2011-002160 | A | 1/2011 |
| JP | 5471059 | B2 * | 4/2014 |

OTHER PUBLICATIONS

Japanese Office Action dated Mar. 17, 2020 issued in corresponding JP patent application No. 2018-552355 ( and English translation).
International Search Report of the International Searching Authority dated Feb. 21, 2017 for the corresponding international application No. PCT/JP2016/085004 (and English translation).
Office Action dated Jul. 22, 2020 issued in corresponding CN patent application No. 201680090216.9 (and English translation).

* cited by examiner

REFRIGERATION CYCLE APPARATUS

CROSS REFERENCE TO RELATED APPLICATION

This application is a U.S. national stage application of International Application PCT/JP2016/085004, filed on Nov. 25, 2016, the contents of which are incorporated herein by reference.

TECHNICAL FIELD

The present invention relates to a refrigeration cycle apparatus, and particularly to a refrigeration cycle apparatus including a plurality of compressors.

BACKGROUND

In a conventional multi air conditioning system including a plurality of outdoor units and a plurality of indoor units, refrigerant is transported through a common refrigerant pipe (a liquid pipe and a gas pipe) that connects a plurality of outdoor units to an indoor unit. Also, the compressors of the outdoor units communicate with one another via oil equalizing pipes to avoid uneven distribution of oil among the compressors. This keeps the balance of oil quantity among the compressors of the outdoor units.

Using oil equalizing pipes, however, is disadvantageous in terms of the ease of installation work at the site and in terms of the cost. Also, an improper oil quantity in each compressor would deteriorate the performance of the compressor, thus disadvantageously increasing the power consumption.

Accordingly, Japanese Patent Laying-Open No. 2007-101127 (PTL 1), Japanese Patent Laying-Open No. 2004-69213 (PTL 2), and Japanese Patent Laying-Open No. 2011-2160 (PTL 3) disclose a method for controlling an air conditioner using a technique for avoiding uneven distribution of oil among compressors without using oil equalizing pipes.

PATENT LITERATURE

PTL 1: Japanese Patent Laying-Open No. 2007-101127
PTL 2: Japanese Patent Laying-Open No. 2004-69213
PTL 3: Japanese Patent Laying-Open No. 2011-2160

In Japanese Patent Laying-Open No. 2007-101127 (PTL 1), in order to keep a proper oil quantity in the compressors, an oil equalizing operation is performed with a fixed period of oil supply to the compressors in oil equalizing operation control. In Japanese Patent Laying-Open No. 2004-69213 (PTL 2), control is performed to switch operation/stop of each compressor when the operation total time of the compressor reaches a predetermined time.

However, since the oil equalizing operation time or the operation total time is determined in a uniform manner, oil equalization may not be sufficient depending on the conditions of environment, installation, and operation. Compressors with depletion of oil would deteriorate in reliability, while compressors overfilled with oil would deteriorate in performance.

SUMMARY

The present invention has been made to solve the above problems. An object of the present invention is to accurately detect the quantity of refrigeration oil using a sensor, and to control a plurality of compressors so as to avoid uneven distribution of refrigeration oil in the containers of the compressors, thus protecting the compressors and preventing deterioration in performance of the compressors and the refrigeration cycle apparatus.

A refrigeration cycle apparatus disclosed in an embodiment of the present application includes an indoor unit including at least an indoor heat exchanger; a plurality of outdoor units connected in parallel to each other and connected to the indoor unit; a controller to control the plurality of outdoor units; and at least one expansion device. Each of the plurality of outdoor units includes an outdoor heat exchanger, a compressor, and a sensor to detect a quantity of refrigeration oil in the outdoor unit. The indoor heat exchanger, the expansion device, the outdoor heat exchanger, and the compressor constitute a refrigerant circuit through which refrigerant circulates, the outdoor heat exchanger and the compressor being included in each of the plurality of outdoor units. As an operation mode, the controller has a first operation mode in which a part of the plurality of outdoor units is operated and another outdoor unit is stopped, and a second operation mode in which all of the plurality of outdoor units are operated. In the first operation mode, when an operating time of an operating outdoor unit exceeds a prescribed time and the quantity of refrigeration oil in the compressor of the operating outdoor unit is smaller than a prescribed quantity, the controller maintains operation of the operating outdoor unit. In the first operation mode, when the operating time of the operating outdoor unit exceeds the prescribed time and the quantity of refrigeration oil in the compressor of the operating outdoor unit is equal to or larger than the prescribed quantity, the controller stops the operating outdoor unit and makes a switch to bring a stopped outdoor unit of the plurality of outdoor units into operation.

According to the present invention, depletion of oil in each of a plurality of compressors is prevented, and thus the reliability of each compressor is improved. Since depletion of oil is prevented without using oil equalizing pipes, there is no need to connect an oil equalizing pipe for each outdoor unit. Thus, the ease of installation work is improved.

DETAILED DESCRIPTION

Figure 1:
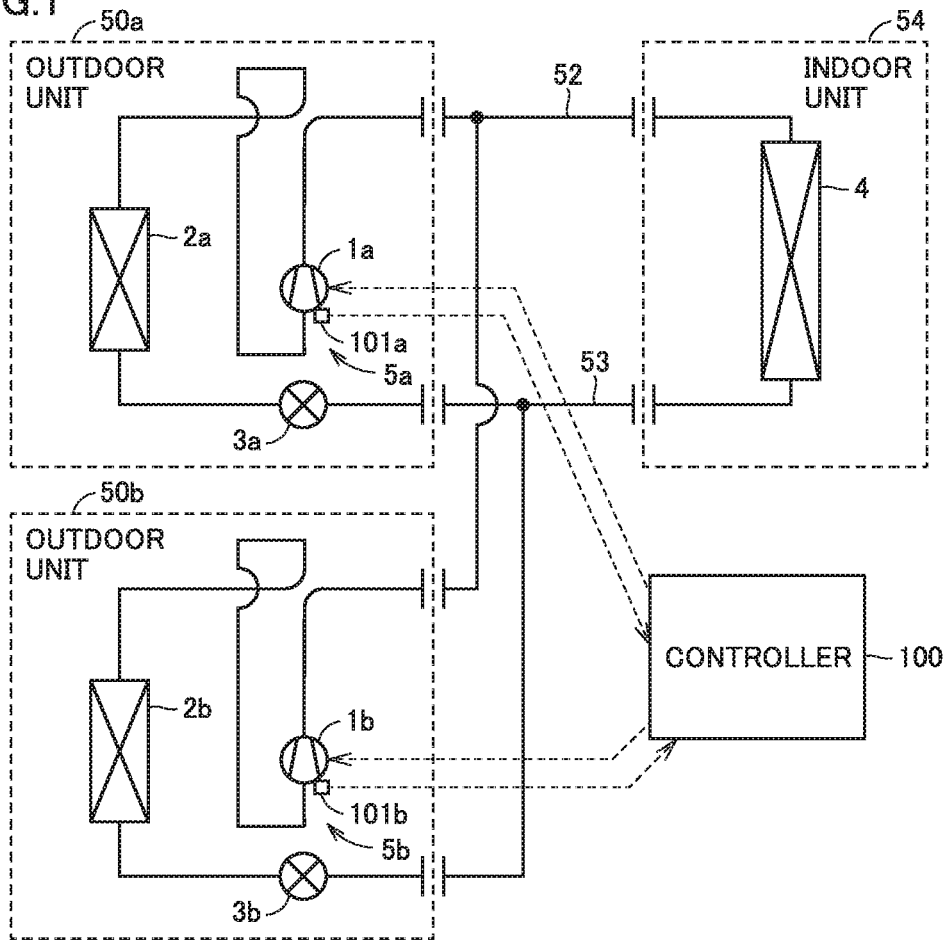
FIG. 1 is a general configuration diagram of a refrigeration cycle apparatus in embodiment 1.

Embodiments of the present invention are hereinafter described in detail with reference to the drawings. Although a plurality of embodiments are described hereinafter, it is assumed at the time of filing of the application that the features described in the embodiments may be combined as appropriate. Identical or corresponding parts in the drawings are identically denoted, and the explanation thereof is not repeated.

Embodiment 1

FIG. 1 is a general configuration diagram of a refrigeration cycle apparatus in embodiment 1. With reference to FIG. 1, the refrigeration cycle apparatus includes a plurality of outdoor units 50*a*, 50*b*, an indoor unit 54 including at least an indoor heat exchanger 4, a pipe 52 on the high-pressure side, a pipe 53 on the low-pressure side, and a controller 100. Outdoor units 50*a*, 50*b* are connected to indoor unit 54 via pipe 52 and pipe 53.

Outdoor units 50*a*, 50*b* are connected in parallel to each other and are connected to indoor unit 54. Outdoor unit 50*a* includes at least a compressor 1*a*, an outdoor heat exchanger 2*a*, and an expansion device 3*a*. Outdoor unit 50*b* includes at least a compressor 1*b*, an outdoor heat exchanger 2*b*, and an expansion device 3*b*. Electronic expansion valves (LEVs) are often used as expansion devices 3*a*, 3*b*. However, capillary tubes, thermostatic expansion valves or the like may also be used. Instead of expansion devices 3*a*, 3*b*, a single expansion device may be provided in the indoor unit.

Indoor heat exchanger 4, expansion devices 3*a*, 3*b*, outdoor heat exchangers 2*a*, 2*b*, and compressors 1*a*, 1*b* constitute a refrigerant circuit through which refrigerant circulates.

Outdoor units 50*a*, 50*b* respectively include outdoor heat exchangers 2*a*, 2*b*, compressors 1*a*, 1*b*, and sensors 5*a*, 5*b* for detecting the quantities of refrigeration oil in the outdoor units. Sensors 5*a*, 5*b* respectively include liquid level detectors 101*a*, 101*b*. That is, compressor 1*a* has liquid level detector 101*a* to detect the liquid level in the compressor, and compressor 1*b* has liquid level detector 101*b* to detect the liquid level in the compressor. Controller 100 controls the quantities of discharge from compressors 1*a*, 1*b* in accordance with the liquid levels (outputs of liquid level detectors 101*a*, 101*b*) in the compressors.

Controller 100 switches between the single-outdoor-unit operation and the multi-outdoor-unit operation as appropriate in accordance with the load on the refrigeration cycle apparatus. Here, the "single-outdoor-unit operation" refers to the operation in which two outdoor units include one operating compressor and one stopped compressor at the same time. The "multi-outdoor-unit operation" refers to the operation in which a plurality of outdoor units include two or more operating compressors at the same time. If three or more outdoor units are connected in parallel, the single-outdoor-unit operation refers to the case in which only one of all compressors is operated.

The "single-outdoor-unit operation" mode corresponds to a first operation mode in which a part of a plurality of outdoor units 50*a*, 50*b* is operated and the other outdoor unit is stopped. The "multi-outdoor-unit operation" mode corresponds to a second operation mode in which all of a plurality of outdoor units 50*a*, 50*b* are operated.

Such a refrigeration cycle apparatus in embodiment 1, in which a plurality of outdoor units are used, may cause uneven distribution of oil and the resulting depletion of oil after a long-time continuous operation. Specifically, a large quantity of refrigeration oil may be discharged into the pipes, depending on the state of operation of the compressors in the outdoor units. This may cause the refrigeration oil to be unevenly distributed in a part of the outdoor units and may cause depletion of refrigeration oil in the compressor of the remaining outdoor unit(s).

The compressors in a continuing uneven state without oil equalizing will reduce in reliability. Consideration might be given to providing oil equalizing pipes for equalizing the quantities of the refrigeration oil in the compressors. However, providing oil equalizing pipes requires a larger number of connections during the installation work and requires a larger number of components, thus reducing the ease of installation work.

In view of this, controller 100 of the refrigeration cycle apparatus in embodiment 1 controls a plurality of compressors so that the refrigeration oil discharged into the pipes can appropriately return to the compressors. In the "single-outdoor-unit operation" mode, if the operating time of an operating outdoor unit exceeds a prescribed time, and the quantity of refrigeration oil in the compressor of the operating outdoor unit is smaller than a prescribed quantity, then controller 100 maintains the operation of the operating outdoor unit; and in the "single-outdoor-unit operation" mode, if the operating time of an operating outdoor unit exceeds the prescribed time, and the quantity of refrigeration oil in the compressor of the operating outdoor unit is equal to or larger than the prescribed quantity, then controller 100 stops the operating outdoor unit and makes a switch to bring a stopped one of a plurality of outdoor units 50*a*, 50*b* into operation.

Figure 2:
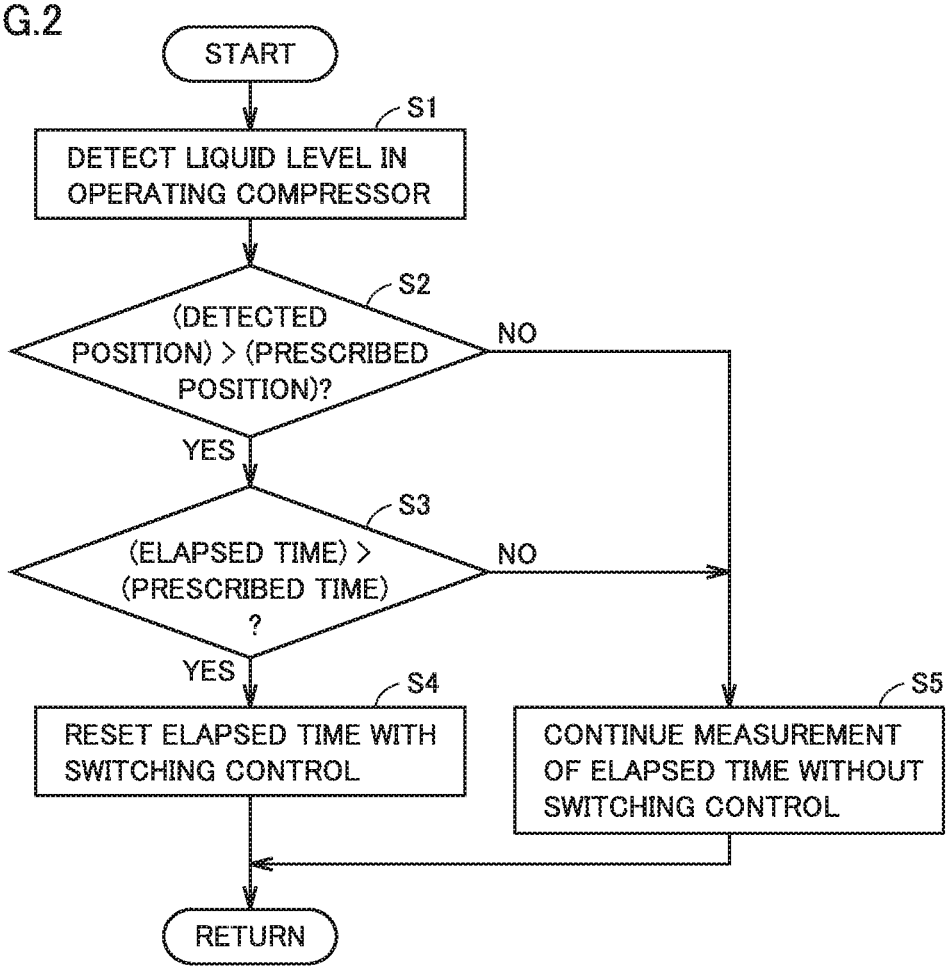
FIG. 2 is a flowchart for explaining the control during the single-outdoor-unit operation to be executed by a controller in embodiment 1.
Figure 3:
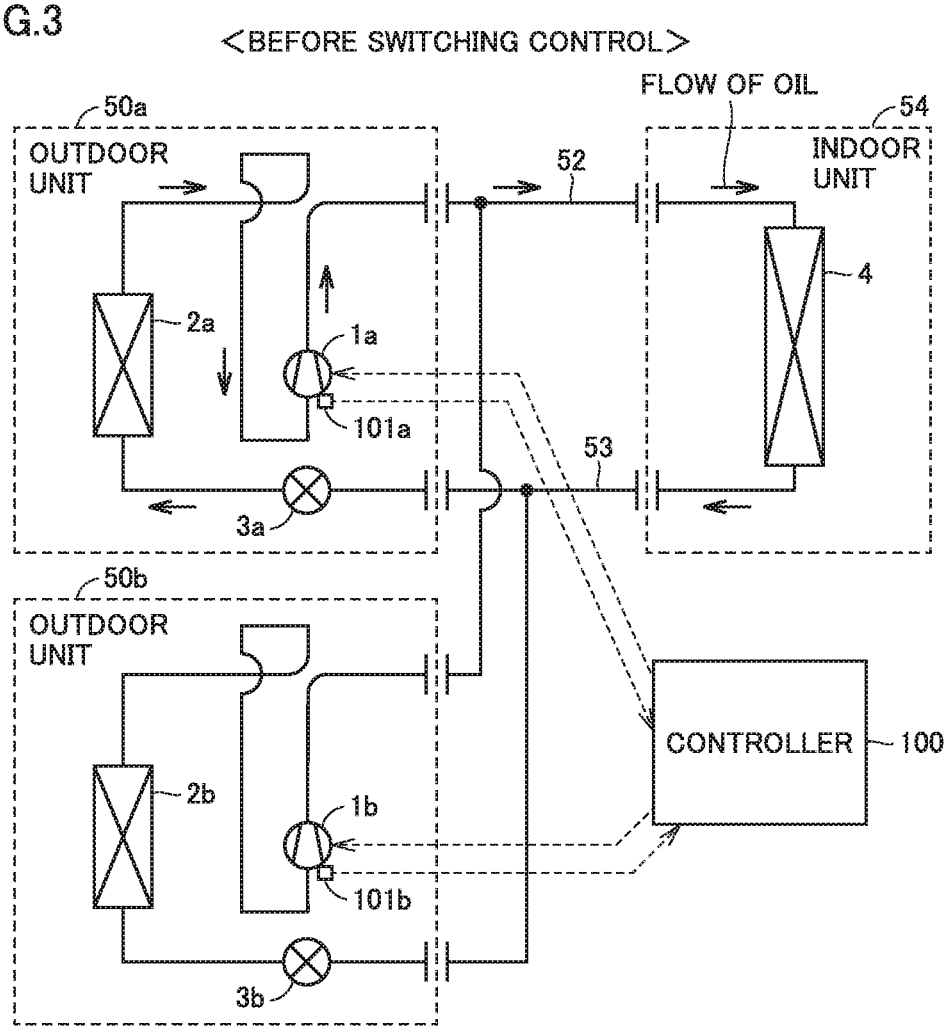
FIG. 3 shows a flow of refrigerant before switching between outdoor units during the single-outdoor-unit operation in embodiment 1.
Figure 4:
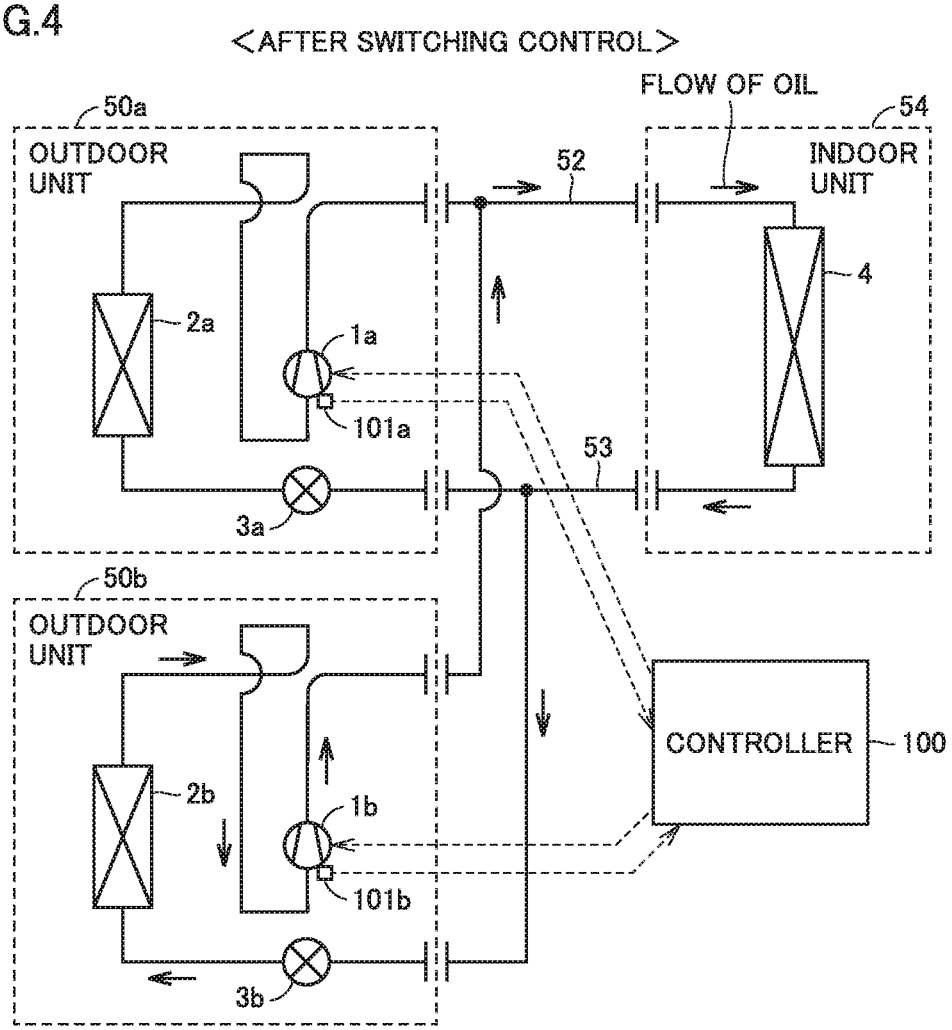
FIG. 4 shows a flow of refrigerant after switching between outdoor units during the single-outdoor-unit operation in embodiment 1.

The control during the above-described single-outdoor-unit operation is described. FIG. 2 is a flowchart for explaining the control during the single-outdoor-unit operation to be executed by the controller in embodiment 1. FIG. 3 shows a flow of refrigerant before switching between outdoor units during the single-outdoor-unit operation in embodiment 1. FIG. 4 shows a flow of refrigerant after switching between outdoor units during the single-outdoor-unit operation in embodiment 1.

With reference to FIG. 2, the process in the flowchart is called for execution from the main routine of the control of the refrigeration cycle apparatus, each time a certain time has elapsed or a predetermined condition is satisfied.

At step S1, controller 100 detects the liquid level in an operating compressor. If the operating compressor is compressor 1*a*, the refrigerant flows as indicated by the arrows shown in FIG. 3 at this time. In this state, controller 100 detects the liquid level in operating compressor 1*a* based on the output of liquid level detector 101*a*.

Liquid level detector 101*a* may be any detector that can detect the liquid level. Examples of liquid level detector 101*a* include: an ultrasonic sensor to detect based on the transmission time of an ultrasonic wave, a sound velocity sensor to detect the sound velocity of a sound wave, a heat capacity sensor to detect the heat capacity, a capacitance sensor to detect the capacitance, and an optical fiber sensor to detect, for example, the wavelength of the light from a light source. Each of these sensors changes its detection value in response to a change in density of the observation space.

A temperature sensor may also be used as liquid level detector 101*a*. The temperature sensor detects the above-described liquid level indirectly, unlike the sensors that determines the liquid level directly. The installation position of the temperature sensor is preferably inside of a compressor. However, it may be outside of a compressor. In the space inside a compressor, refrigerant and refrigeration oil exist in the state where a gas part and a liquid part are separated from each other. Since the gas part and the liquid part have different heat capacities, the temperature sensor shows a temperature difference between these parts. Accordingly, a plurality of temperature sensors may be provided at different heights to detect the temperature difference, so that the liquid part or the gas part can be determined. In this way, the liquid level can be estimated.

As shown in FIG. 3, the refrigerant and refrigeration oil are released from compressor 1*a*. The released refrigerant and refrigeration oil pass through pipe 52, indoor heat exchanger 4, pipe 53, expansion device 3*a*, and outdoor heat exchanger 2*a* in this order, and return to compressor 1*a*. If a large quantity of refrigeration oil temporarily stays in the refrigerant circuit, such as the pipes and the heat exchangers, the inflow quantity of refrigeration oil to compressor 1*a* is decreased. The decrease in inflow quantity causes a decrease in liquid level in compressor 1*a*.

At step S2, controller 100 determines whether or not the liquid surface position detected by liquid level detector 101*a* is higher than a prescribed position (whether or not the quantity of refrigeration oil is larger than a prescribed quantity). The "prescribed position" refers to the position of the liquid surface that ensures the reliability of compressor.

If the liquid level is lower than the prescribed position at step S2 (NO at S2), switching control is not performed until the liquid level in compressor 1*a* is restored and until the inflow quantity of refrigeration oil to compressor 1*a* is stabilized (S5). Here, the "switching control" refers to the control in which a plurality of compressors are switched so that an operating compressor stops operation and a stopped compressor is brought into operation.

At step S3, controller 100 determines whether or not the elapsed time from the start of operation of compressor 1*a* is longer than a prescribed time. Here, the "prescribed time" refers to the time, after the elapse of which the switching control is forced to be performed.

If the liquid level is equal to or higher than the prescribed position (YES at S2) and the elapsed time is equal to or longer than the prescribed time (YES at S3), then controller 100 switches the compressor to operate from compressor 1*a* to compressor 1*b* and resets the counter value of the elapsed time (S4). When the counter value of the elapsed time is reset, the count of elapsed time is newly started.

After the switching, as shown in FIG. 4, the refrigerant and refrigeration oil are released from compressor 1*b*. The released refrigerant and refrigeration oil pass through pipe 52, indoor heat exchanger 4, pipe 53, expansion device 3*b*, and outdoor heat exchanger 2*b* in this order, and return to compressor 1*b*.

Immediately after the switching, the refrigeration oil that was released from compressor 1*a* into pipe 52, indoor heat exchanger 4, and pipe 53 before that time flows into compressor 1*b*. However, the inflow quantity can be maintained at almost the same quantity for each switching control time, by appropriately choosing the switching timing so that the switching timing does not coincide with the moment at which a large quantity of refrigeration oil flows out from the compressor. Accordingly, a situation where a large quantity of refrigeration oil moves from one compressor to the other compressor can be avoided.

By such control, the compressor to be operated is switched each time the prescribed time has elapsed. This reduces the risk of uneven distribution of refrigeration oil in one compressor. Further, the switching timing is chosen so as to avoid the state in which a large quantity of refrigeration oil temporarily stays, for example, in the pipes. Accordingly, depletion of refrigeration oil is prevented in both compressors.

Next, the control during the multi-outdoor-unit operation is described.

In the "multi-outdoor-unit operation" mode, if the quantity of refrigeration oil in the compressor of a first outdoor unit of a plurality of outdoor units 50*a*, 50*b* is smaller than a prescribed quantity, then controller 100 controls a plurality of outdoor units 50*a*, 50*b* so as to increase the discharging refrigerant flow rate of the compressor of the first outdoor unit and so as to decrease the discharging refrigerant flow rate of the compressor of the second outdoor unit. That is, if the quantity of refrigeration oil in compressor 1*a* of outdoor unit 50*a* is smaller than the prescribed quantity, then the discharging refrigerant flow rate of compressor 1*a* is increased and the discharging refrigerant flow rate of compressor 1*b* is decreased. The discharging refrigerant flow rate changes in accordance with the frequency of the compressor. Accordingly, if the quantity of refrigeration oil in compressor 1*a* of outdoor unit 50*a* is smaller than the prescribed quantity, then the operation frequency of compressor 1*a* is increased and the operation frequency of compressor 1*b* is decreased. Thus, a large proportion of the refrigeration oil that has stayed inside pipes 52, 53 and indoor heat exchanger 4 returns to compressor 1*a*.

Figure 5:
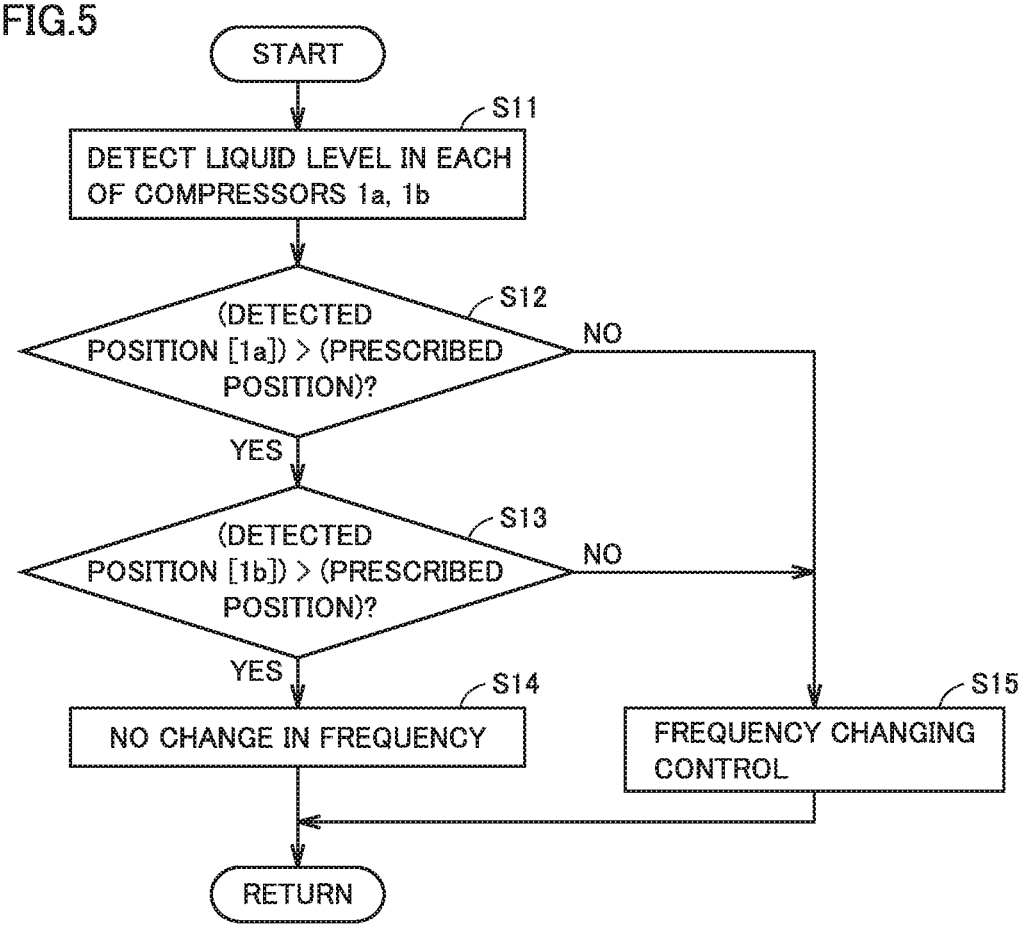
FIG. 5 is a flowchart for explaining the control during the multi-outdoor-unit operation to be executed by the controller in embodiment 1.
Figure 6:
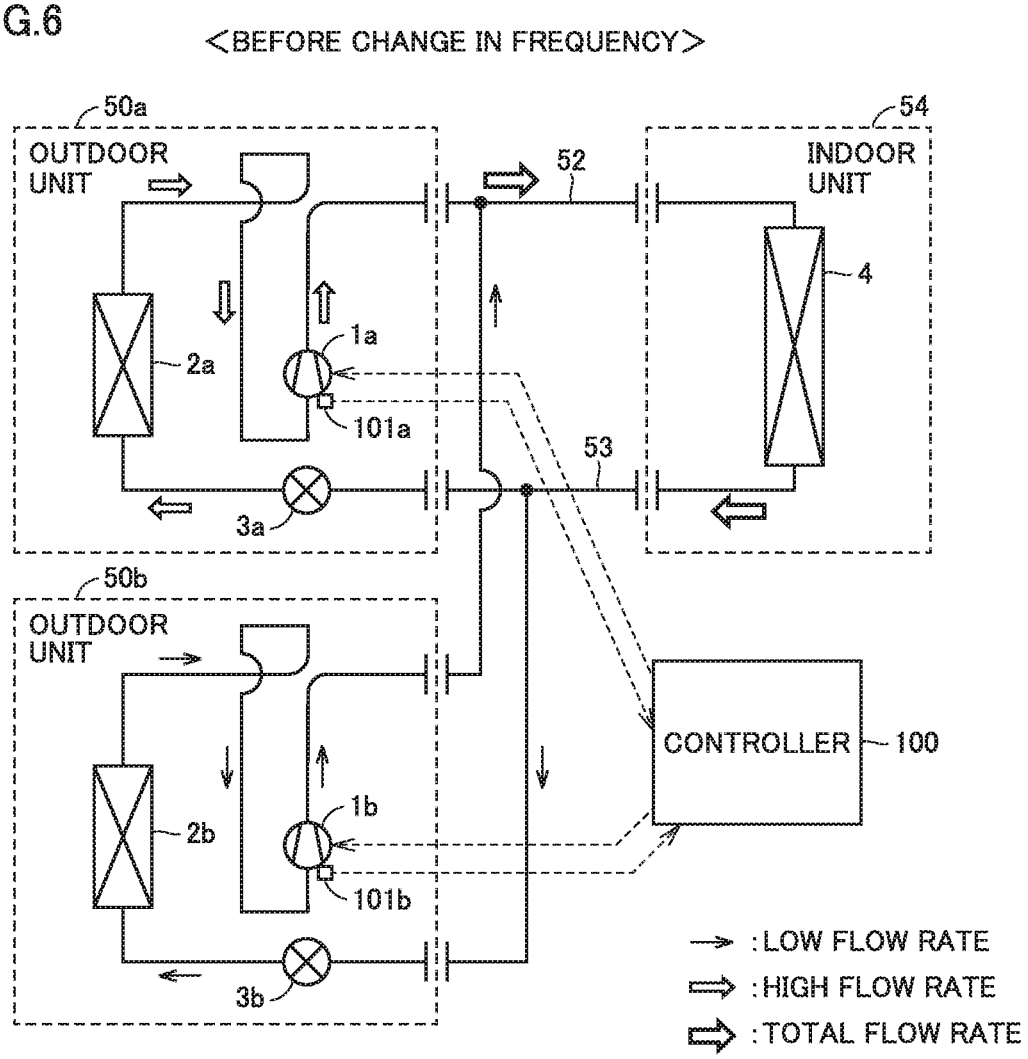
FIG. 6 shows an example flow of refrigerant before a change of frequency during the multi-outdoor-unit operation.
Figure 7:
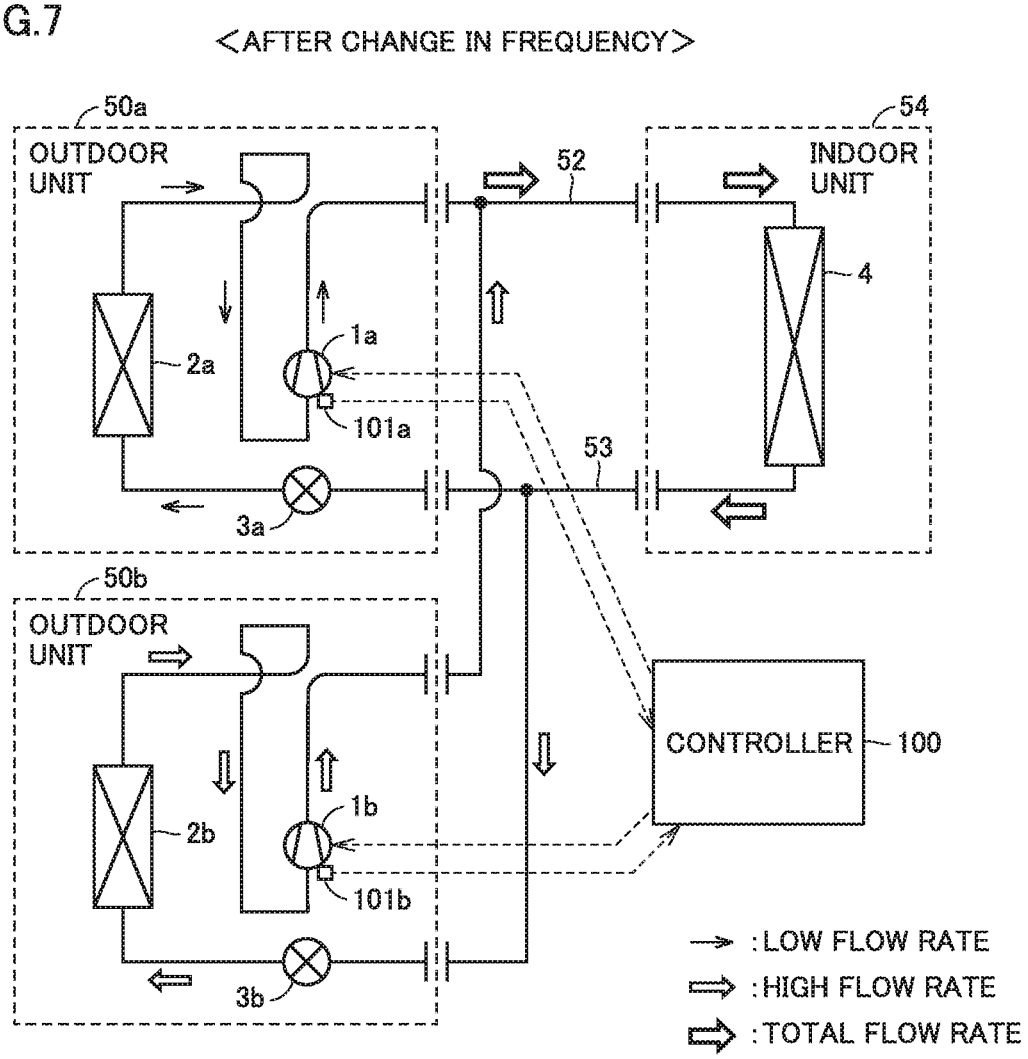
FIG. 7 shows an example flow of refrigerant after a change of frequency during the multi-outdoor-unit operation.

In the "multi-outdoor-unit operation" mode, controller 100 executes "frequency control". Here, the "frequency control" refers to the control to increase the frequency of the compressor whose liquid level is lower than a prescribed position, and to decrease the frequency of the compressor whose liquid level is equal to or higher than the prescribed position, so as to maintain a constant indoor capacity. FIG. 5 is a flowchart for explaining the control during the "multi-outdoor-unit operation" to be executed by the controller in embodiment 1. FIG. 6 shows an example flow of refrigerant before a change of frequency during the multi-outdoor-unit operation. FIG. 7 shows an example flow of refrigerant after a change of frequency during the multi-outdoor-unit operation.

With reference to FIG. 5, the process in the flowchart is called for execution from the main routine of the control of the refrigeration cycle apparatus, each time a certain time has elapsed or a predetermined condition is satisfied.

At step S11, controller 100 detects the liquid level in each of operating compressors 1*a*, 1*b*. Here, suppose the refrigerant flow rate of compressor 1*b* is a low flow rate and the refrigerant flow rate of compressor 1*a* is a high flow rate that is higher than the refrigerant flow rate of compressor 1*b*, as shown in FIG. 6. The refrigerant flow rate in indoor heat exchanger 4 of indoor unit 54 is a higher total flow rate. In this state, controller 100 detects the liquid levels in operating compressors 1*a*, 1*b* respectively based on the outputs of liquid level detectors 101*a*, 101*b*.

At step S12, controller 100 determines whether or not the detected position of the liquid level in compressor 1*a* is higher than a prescribed position.

At step S13, controller 100 determines whether or not the detected position of the liquid level in compressor 1*b* is higher than a prescribed position.

If the liquid level is higher than the prescribed position in both compressor 1*a* and compressor 1*b* (YES at S12, S13), depletion of oil has not occurred in either of the compressors. Accordingly, the operation frequency of each of compressors 1*a*, 1*b* is maintained with no change (step S14).

On the other hand, if the liquid level in compressor 1*a* is equal to or lower than the prescribed position (NO at S12), or the liquid level in compressor 1*b* is equal to or lower than the prescribed position (NO at S13), then depletion of oil has occurred in any of the compressors. In this case, controller 100 performs the control to change the operation frequency of the compressor at step S15.

For example, if the liquid level in compressor 1*a* is decreased to lower than the prescribed position during operation at the refrigerant flow rate shown in FIG. 6 (NO at S12), controller 100 executes the control to change (increase) the operation frequency of compressor 1*a*, thereby increasing the discharging flow rate of compressor 1*a* (high flow rate) to increase the inflow quantity of refrigeration oil to compressor 1*a*, as shown in FIG. 7. On the other hand, controller 100 executes the control to change (decrease) the operation frequency of compressor 1*b*. Controller 100 decreases the discharging flow rate of compressor 1*b* (low flow rate) to decrease the oil inflow quantity to compressor 1*b* in accordance with the increase in discharging flow rate of compressor 1*a*, so that the rate of flow to the indoor unit is constant. The same applies to the case in which the relation between the liquid levels in compressors 1*a* and 1*b* are inverse. That is, the compressor whose liquid level is lower than the prescribed position is increased in frequency, and the compressor whose liquid level is equal to or higher than the prescribed position is decreased in frequency.

As described above, in the refrigeration cycle apparatus in embodiment 1, during execution of the single-outdoor-unit operation, if the liquid level in an operating compressor is equal to or higher than the prescribed position and the operating time is equal to or longer than the prescribed time, then the switching control is executed to stop the operating compressor and bring a stopped compressor into operation. During execution of the multi-outdoor-unit operation, if there is a compressor whose liquid level is lower than the prescribed position, the frequency of compressor is controlled so that the liquid level is increased. For example, a compressor whose liquid level is lower than the prescribed position is increased in frequency, and a compressor whose liquid level is equal to or higher than the prescribed position is decreased in frequency. At this time, the frequency is controlled so that the indoor capacity is constant (i.e., so that the total value of refrigerant flow rate is constant).

The control as described above brings about the following advantageous effects. By detecting the liquid level, depletion of oil in each compressor is prevented in each operation condition, environmental condition, and installation condition. Further, the compressor to be operated can be switched while a sufficient liquid level is ensured. Thus, the reliability of each compressor is improved.

With the configuration and the control of the refrigeration cycle apparatus in embodiment 1, depletion of oil is prevented without using oil equalizing pipes. A configuration that requires oil equalizing pipes would need connection of an oil equalizing pipe for each of a plurality of outdoor units when they are installed. The refrigeration cycle apparatus in embodiment 1, on the other hand, eliminates the need for connection of an oil equalizing pipe for each outdoor unit, thus improving the ease of installation work.

Embodiment 2

Figure 8:
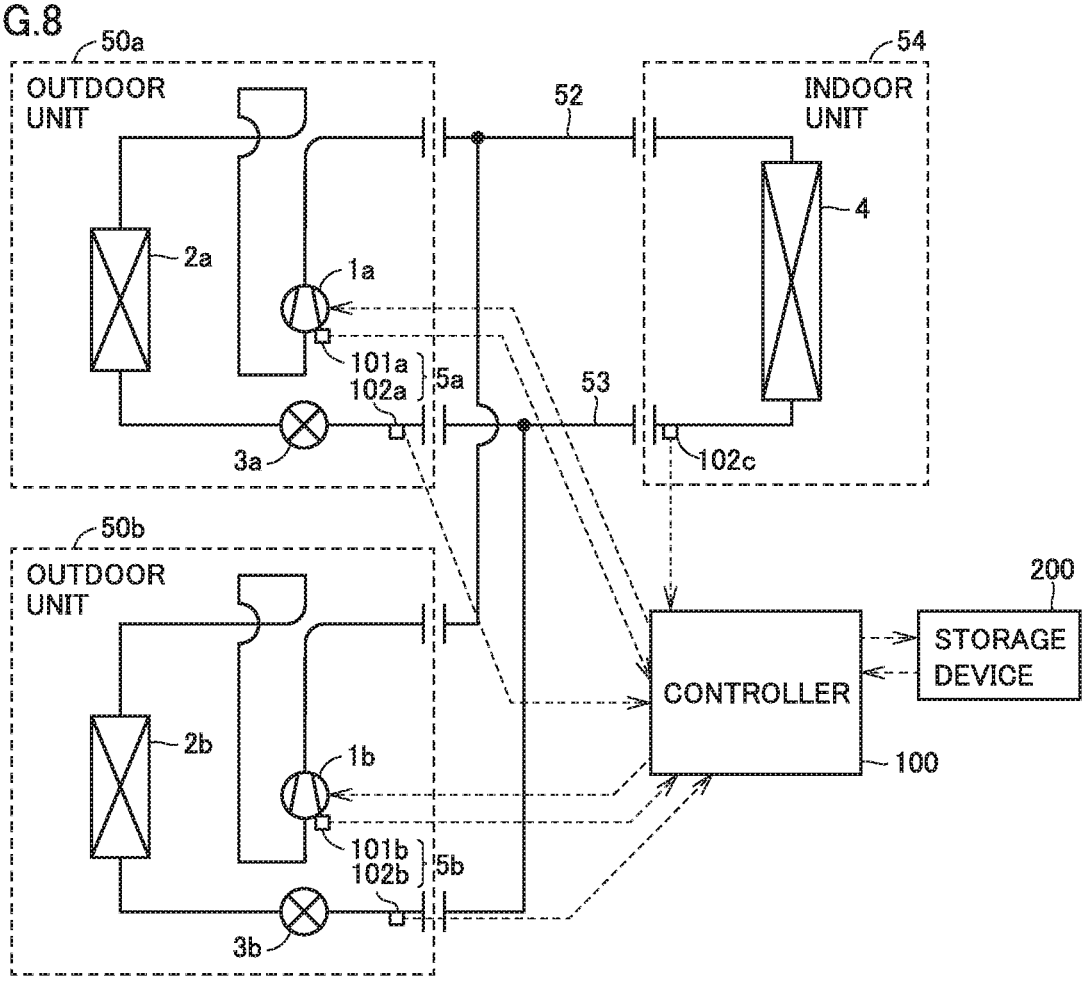
FIG. 8 is a general configuration diagram of a refrigeration cycle apparatus in embodiment 2.

FIG. 8 is a general configuration diagram of a refrigeration cycle apparatus in embodiment 2. With reference to FIG. 8, the refrigeration cycle apparatus in embodiment 2 further includes position detectors 102*a*, 102*b*, 102*c* to detect the pipe length of pipe 52 and pipe 53, and a storage device 200, in addition to the configuration of the refrigeration cycle apparatus shown in FIG. 1. A sensor 5*a* includes liquid level detector 101*a* and position detector 102*a*. A sensor 5*b* includes liquid level detector 101*b* and position detector 102*b*. Controller 100 calculates the oil outflow quantity based on the conversion of the liquid level and frequency of each of compressors 1*a*, 1*b*, and calculates an estimated oil return time T based on the conversion of the oil outflow quantity and the pipe length. In storage device 200, a target oil return time T* that was determined in advance by, for example, experiments is stored. Here, the "oil return time" refers to the time required for the liquid level of refrigeration oil in a compressor to be restored after being temporarily decreased. Controller 100 controls each compressor in accordance with estimated oil return time T, the liquid level, and target oil return time T*. The other configuration of the refrigeration cycle apparatus in embodiment 2 is the same as that of the refrigeration cycle apparatus in FIG. 1, and thus the explanation thereof is not repeated.

One of the features of embodiment 2 is that the oil return time is estimated by detecting the pipe length. That is, controller 100 calculates the length of refrigerant pipe 53 based on the outputs of position detectors 102*a* to 102*c*, and, based on the calculated length of refrigerant pipe 53, calculates the oil return time required for the refrigeration oil discharged from compressors 1*a*, 1*b* to return to compressors 1*a*, 1*b*. Controller 100 controls the quantities of discharge from compressors 1*a*, 1*b* based on the oil return time.

Each of position detectors 102*a*, 102*b*, 102*c* may be any detector that can identify the positions of the outdoor unit and the indoor unit. For example, a pressure sensor may be used as each of the position detectors to estimate the pipe length from the pressure loss and the pressure difference between the openings of the pipe which are determined by the pipe diameter. Alternatively, the pipe length may be estimated from the distance from the indoor unit to the outdoor unit identified by, for example, a GPS device. Alternatively, the length of a communication line that connects the indoor unit and the outdoor unit may be estimated from the current value (quantity of voltage drop), and the length may be determined as the pipe length.

Controller 100 calculates pipe length La of pipes 52, 53 based on the outputs of position detectors 102*a*, 102*b*, 102*c*. After calculating pipe length La, controller 100 converts pipe length La into pipe capacity Va. Controller 100 then estimates oil outflow quantity φa, φb of each compressor based on the relation between the liquid level and the frequency stored in storage device 200 in advance.

Figure 9:
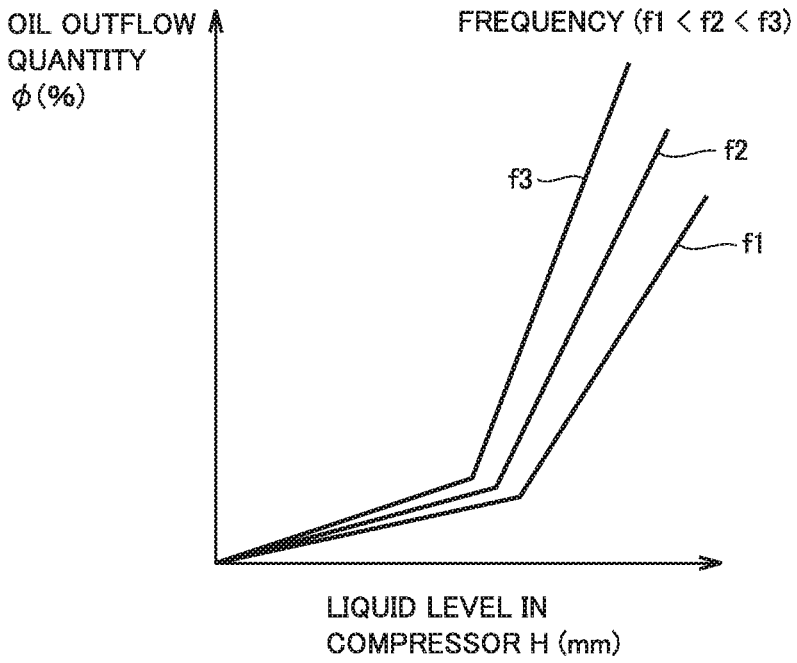
FIG. 9 shows an example relation between the liquid level in compressor and the outflow quantity of refrigeration oil.

FIG. 9 shows an example relation between the liquid level in compressor and the outflow quantity of refrigeration oil. FIG. 9 is by way of example, and the graph depends on the characteristics of the compressor. Therefore, a graph appropriate to the compressor should be used. In FIG. 9, the point of change at which the gradient changes corresponds to the boundary point that determines whether the motor is immersed in the refrigeration oil. If the liquid level is higher than the point of change, then the motor is immersed in the refrigeration oil and the refrigeration oil disposed at equal to or higher than the height of the motor easily flows out to the refrigerant circuit. That is the reason why the gradient steeply increases. Note that some compressors have characteristics with no point of change, unlike the graph in FIG. 9.

Controller 100 estimate discharging flow rate Gra, Grb of each compressor from the operation frequency and displacement volume of the compressor.

When oil outflow quantities φa, φb are obtained from FIG. 9, controller 100 calculates estimated oil return time T by the following formula (1).

$$T=Va/[\{(Gra\times\varphi a)+(Grb\times\varphi b)\}\times\{Gra/(Gra+Grb)\}] \quad (1)$$

Va denotes the pipe capacity (liter); φa, φb denote the oil outflow quantities (%); Gra, Grb denote the discharging flow rates (liter/min); and T denotes the estimated oil return time (min).

In the above formula, the quantity of oil that flows outside the system is expressed by (discharging flow rate)×(oil outflow quantity). The refrigerant and refrigeration oil discharged from the outdoor units join together at the indoor unit. That is, the refrigeration oil discharged from one compressor (for example, 1*b*) also joins. When the flow branches after the joining, the refrigeration oil is distributed at the flow rate ratio. Therefore, the flow rate ratio between compressors 1*a* and 1*b* is multiplied.

The above-described formula (1) expresses the case of two outdoor units 50*a*, 50*b*. The case of n outdoor units 50-1, 50-2, . . . 50-*n* is expressed by the following formula (2).

$$T=Va/[\{(Gr1\times\varphi 1)+(Gr2\times\varphi 2)+\ldots+(Grn\times\varphi n)\}\times\{Gr1/(Gr1+Gr2+\ldots+Grn)\}] \quad (2)$$

Figure 10:
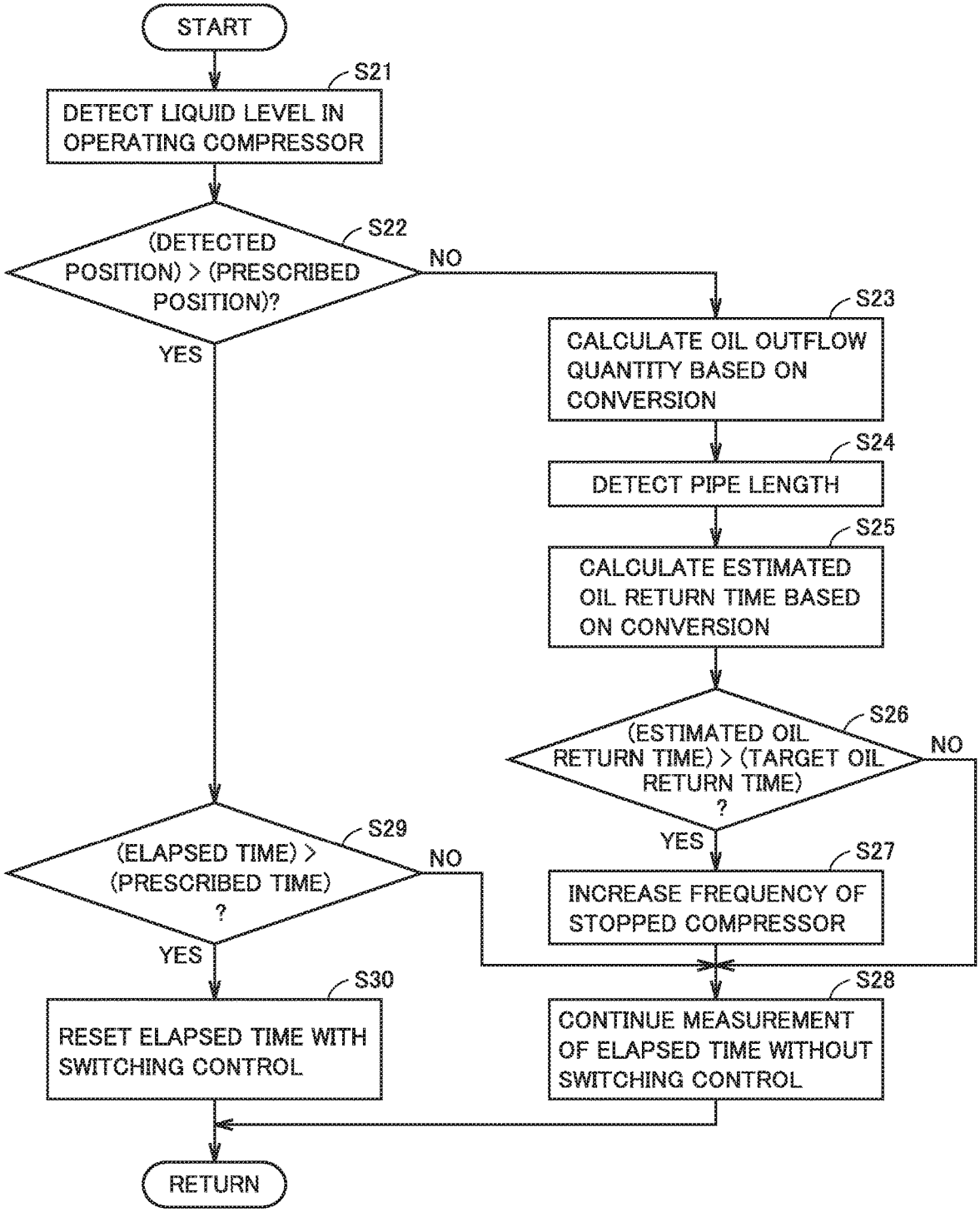
FIG. 10 is a flowchart for explaining the control during the single-outdoor-unit operation to be executed by a controller in embodiment 2.
Figure 11:
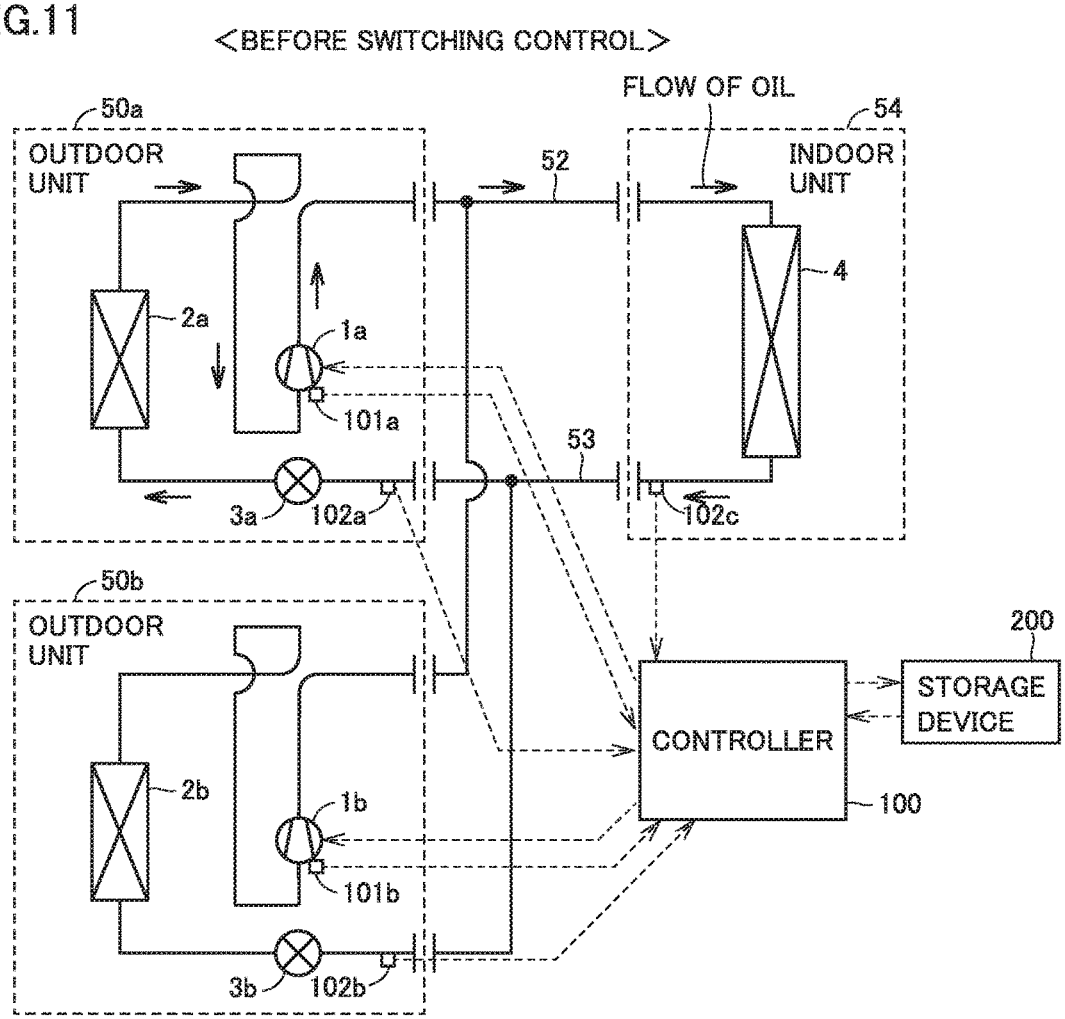
FIG. 11 shows a flow of refrigerant before switching between outdoor units during the single-outdoor-unit operation in embodiment 2.
Figure 12:
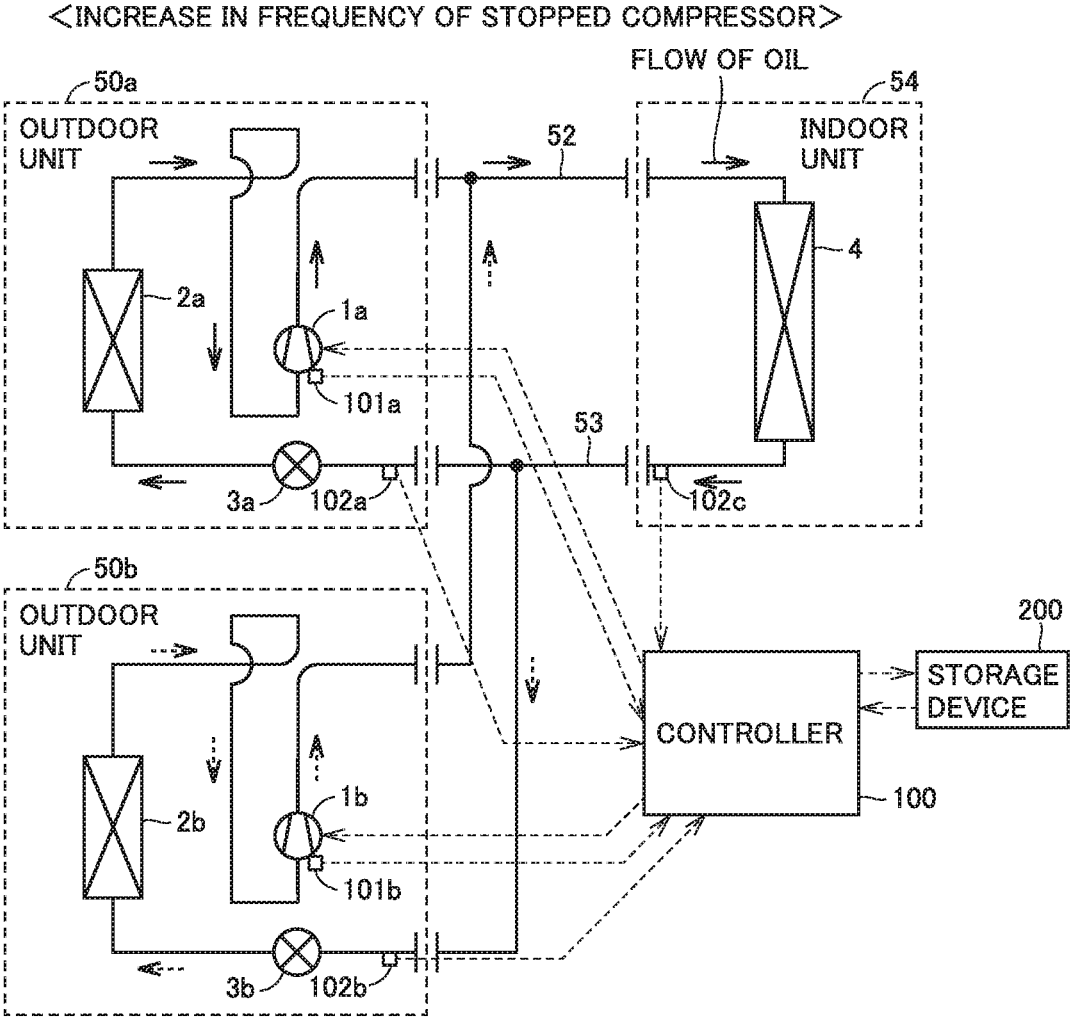
FIG. 12 shows a flow of refrigerant in the process of transition of switching between outdoor units during the single-outdoor-unit operation in embodiment 2.
Figure 13:
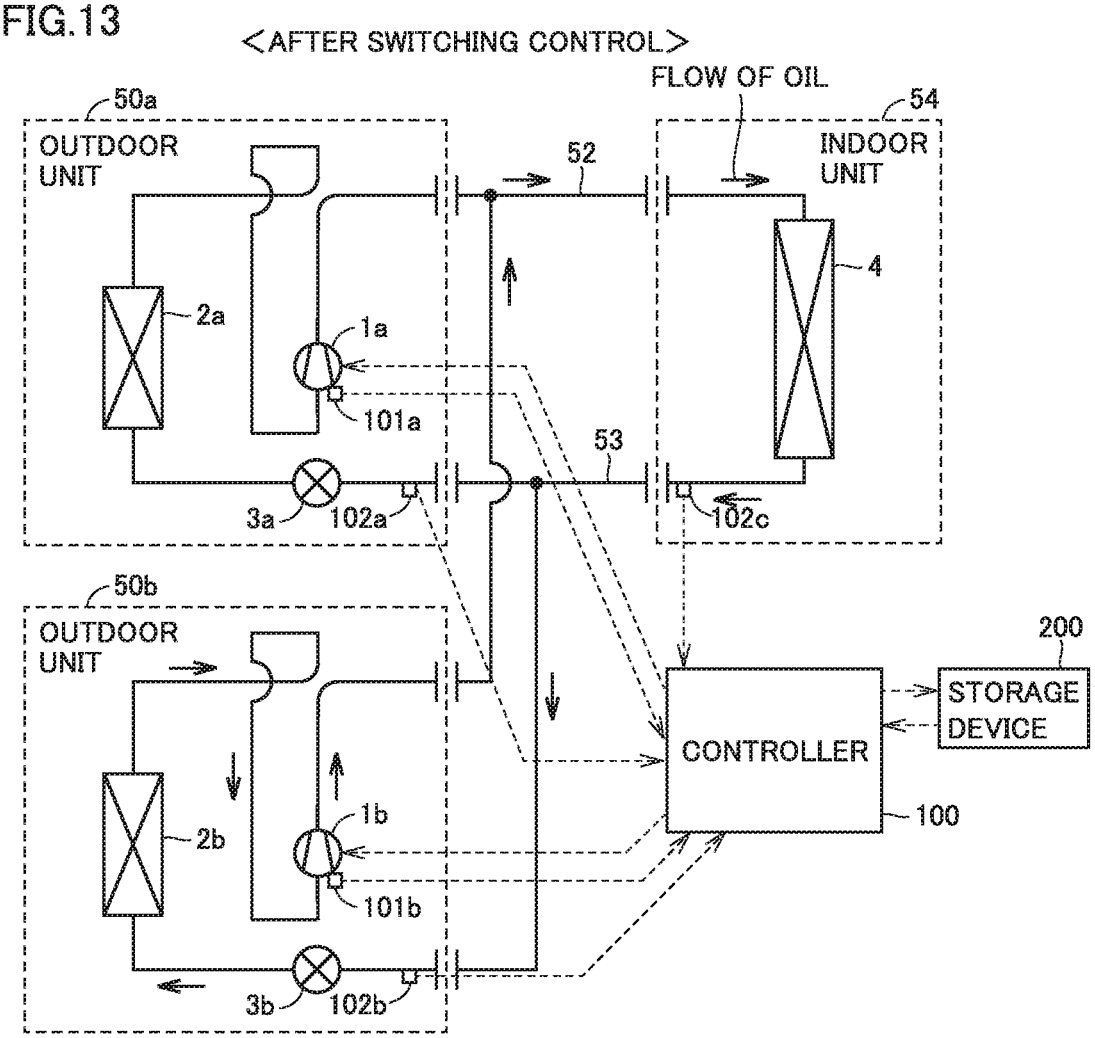
FIG. 13 shows a flow of refrigerant after the completion of switching between outdoor units during the single-outdoor-unit operation in embodiment 2.

First, the control during the single-outdoor-unit operation is described. FIG. 10 is a flowchart for explaining the control during the single-outdoor-unit operation to be executed by the controller in embodiment 2. FIG. 11 shows a flow of refrigerant before switching between outdoor units during the single-outdoor-unit operation in embodiment 2. FIG. 12 shows a flow of refrigerant in the process of transition of switching between outdoor units during the single-outdoor-unit operation in embodiment 2. FIG. 13 shows a flow of refrigerant after the completion of switching between outdoor units during the single-outdoor-unit operation in embodiment 2.

With reference to FIG. 10, first, the liquid level in an operating compressor is detected (S21). If the operating compressor is compressor 1*a*, the refrigerant and refrigeration oil circulate through the refrigerant circuit as indicated by the solid line arrows in FIG. 11. When the refrigerant and refrigeration oil are released from compressor 1*a*, the released refrigerant and refrigeration oil pass through pipe 52, indoor heat exchanger 4, and pipe 53, and return to compressor 1*a*. At this time, if a large quantity of refrigeration oil temporarily stays in the elements of the refrigerant circuit, the inflow quantity to compressor 1*a* is decreased. The decrease in inflow quantity causes a decrease in liquid level in compressor 1*a*.

Controller 100 determines whether or not the detected position of the liquid level is higher than a prescribed position at step S22. If the liquid level is equal to or lower than the prescribed position (NO at S22), controller 100 does not perform the switching control. Controller 100 releases the refrigerant and refrigeration oil from compressor 1*a* so that estimated oil return time T is equal to or shorter than target oil return time T*. Specifically, if (detected position)>(prescribed position) is not satisfied at step S22 (NO at S22), controller 100 calculates the oil outflow quantity from the compressor based on the conversion of the liquid level and the frequency of the compressor, as shown in FIG. 9 (S23), and calculates pipe length La of pipes 52, 53 from the outputs of position detectors 102*a*, 102*b*, 102*c* (S24). After that, the process of calculating estimated oil return time T is executed based on the above-described formula (1) (S25).

Pipe length La can be calculated once after the refrigeration cycle apparatus is installed and can be stored in storage device 200. Pipe length La, therefore, does not necessarily have to be calculated every time.

At step S26, if (estimated oil return time T)>(target oil return time T*) is satisfied, stopped compressor 1*b* is brought into operation and is increased in operation frequency (S27). In this case, as shown in FIG. 12, the circulation of refrigerant and refrigeration oil indicated by the broken line arrows is started, in addition to the circulation of refrigerant and refrigeration oil indicated by the solid line arrows. Thus, when the liquid level of refrigeration oil in the operating compressor temporarily becomes lower than the prescribed position, the lowered liquid level is expected to recover to equal to or higher than the prescribed position at an early stage because of the additional refrigeration oil discharged to pipe 52 from the compressor that has been stopped.

The refrigeration oil released from compressor 1*a* (and compressor 1*b*) passes through the elements of the refrigerant circuit and flows in compressors 1*a* and 1*b* (S28). If the condition is not satisfied at S29 or S26, the process goes on to S28, where the measurement of the elapsed time is continued without performing the switching control.

After that, the process in the flowchart of FIG. 10 is executed again. If the liquid level of refrigeration oil in compressor 1*a* is higher than the prescribed position (YES at S22) and the elapsed time from the switching has exceeded the prescribed time (YES at S29), then controller 100 switches the compressor to operate from compressor 1*a* to compressor 1*b*. At this time, the refrigeration oil that has been released in pipes 52, 53 and indoor heat exchanger 4 flows into compressor 1*b*. Specifically, if (detected position)>(prescribed position) is satisfied (YES at S22) and (elapsed time)>(prescribed time) is satisfied (YES at S29), then the switching control is started and the count of elapsed time is reset (S30). After the process of step S30 is executed, the operating compressor is switched from compressor 1*a* to compressor 1*b*. Accordingly, the flow is changed so that the refrigerant and refrigeration oil circulate through the refrigerant circuit as indicated by the solid line arrows in FIG. 13. Although the operation switching from compressor 1*a* to compressor 1*b* has been described above, the switching from compressor 1*b* to compressor 1*a* can be performed by a similar process.

Figure 14:
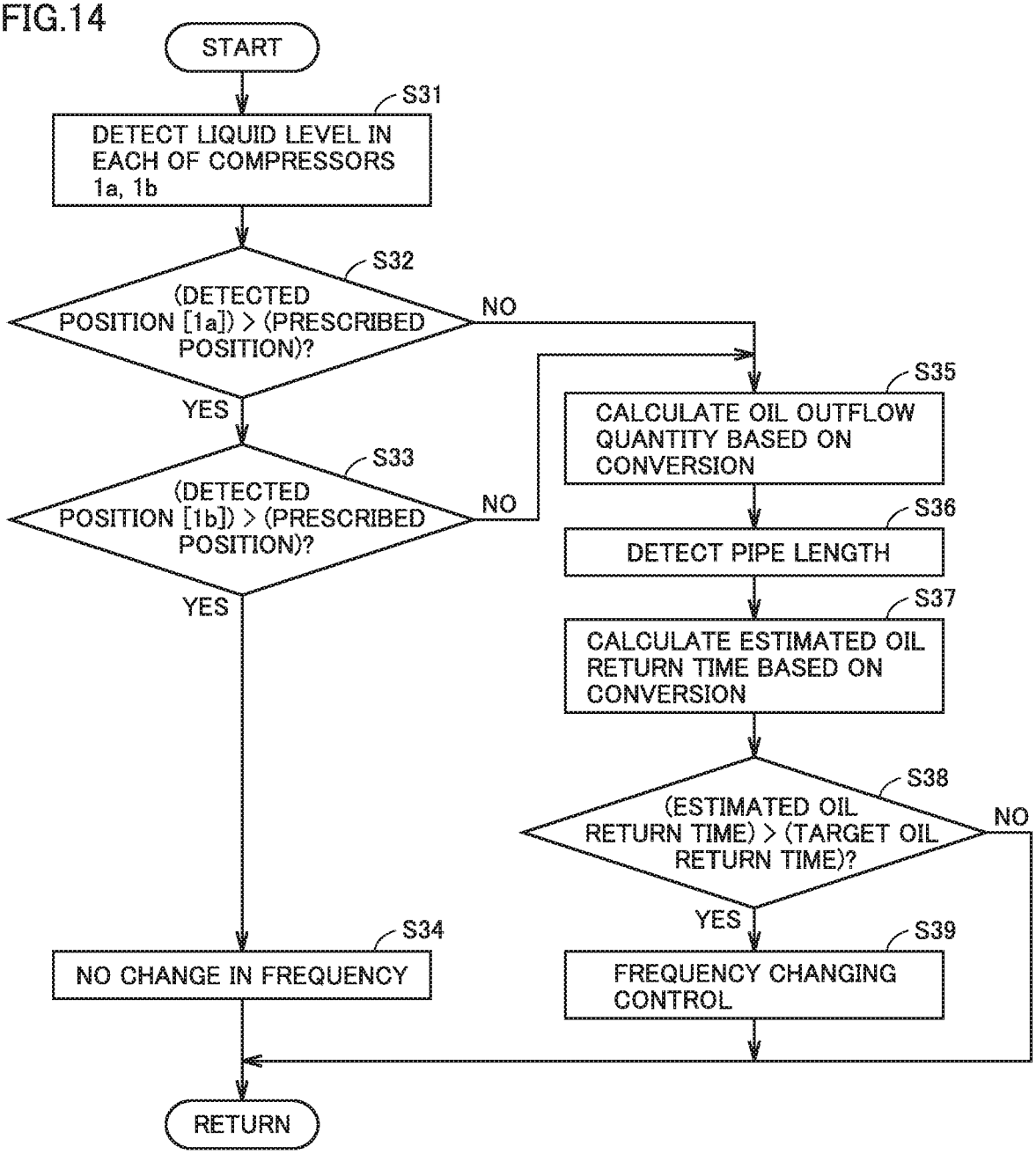
FIG. 14 is a flowchart for explaining the control during the multi-outdoor-unit operation to be executed by the controller in embodiment 2.

FIG. 14 is a flowchart for explaining the control during the multi-outdoor-unit operation to be executed by the controller in embodiment 2. During the multi-outdoor-unit operation, compressors 1*a*, 1*b* are both operating. With reference to FIG. 14, the liquid levels in operating compressors 1*a*, 1*b* are detected (S31). Then, controller 100 determines whether or not the liquid level in compressor 1*a* is higher than a prescribed position (S32), or whether or not the liquid level in compressor 1*b* is higher than a prescribed position (S33).

If the liquid levels of refrigeration oil in compressors 1*a*, 1*b* are both higher than the prescribed position (YES at S32 and S33), the process goes on to step S34, where the operation frequencies of compressors 1*a*, 1*b* are maintained at the current levels with no change in frequency (S34).

On the other hand, if the liquid level of refrigeration oil in any one of compressors 1*a*, 1*b* is equal to or lower than the prescribed position (NO at S32 or S33), the processes of steps S35, S36, S37, S38 are sequentially performed. The processes of steps S35, S36, S37, S38 are respectively the same as the processes of S23, S24, S25, S26 in FIG. 10, and thus the explanation thereof is not repeated.

At step S38, if (estimated oil return time T)>(target oil return time T*) is satisfied, controller 100 executes frequency changing control at step S39. In the frequency changing control, if the liquid level in compressor 1*a* is equal to or lower than the prescribed position for example, the frequency is controlled so that estimated oil return time T is equal to or shorter than the target estimated time. In this case, controller 100 increases the discharging flow rate of compressor 1*a* (high flow rate) to increase the inflow quantity of refrigeration oil. In accordance with the increase in discharging flow rate of compressor 1*a*, controller 100 decreases the discharging flow rate of compressor 1*b* (low flow rate) to decrease the inflow quantity of refrigeration oil to compressor 1*b*, so that the indoor flow rate is constant.

The refrigeration cycle apparatus in embodiment 2 as described above brings about the following advantageous effects.

(1) By detecting the liquid level, depletion of oil in each compressor is prevented in each operation condition, environmental condition, and installation condition. Thus, the reliability is improved.

(2) By shortening the oil return time, reduction in comfort due to the oil return operation is prevented, although the oil return operation is different from the operation for air-conditioning to a preset temperature.

(3) By controlling each compressor in accordance with its oil return time, depletion of oil is prevented and the reliability is improved while the power consumption is reduced, even if the compressors have different oil shortage levels.

Embodiment 3

Figure 15:
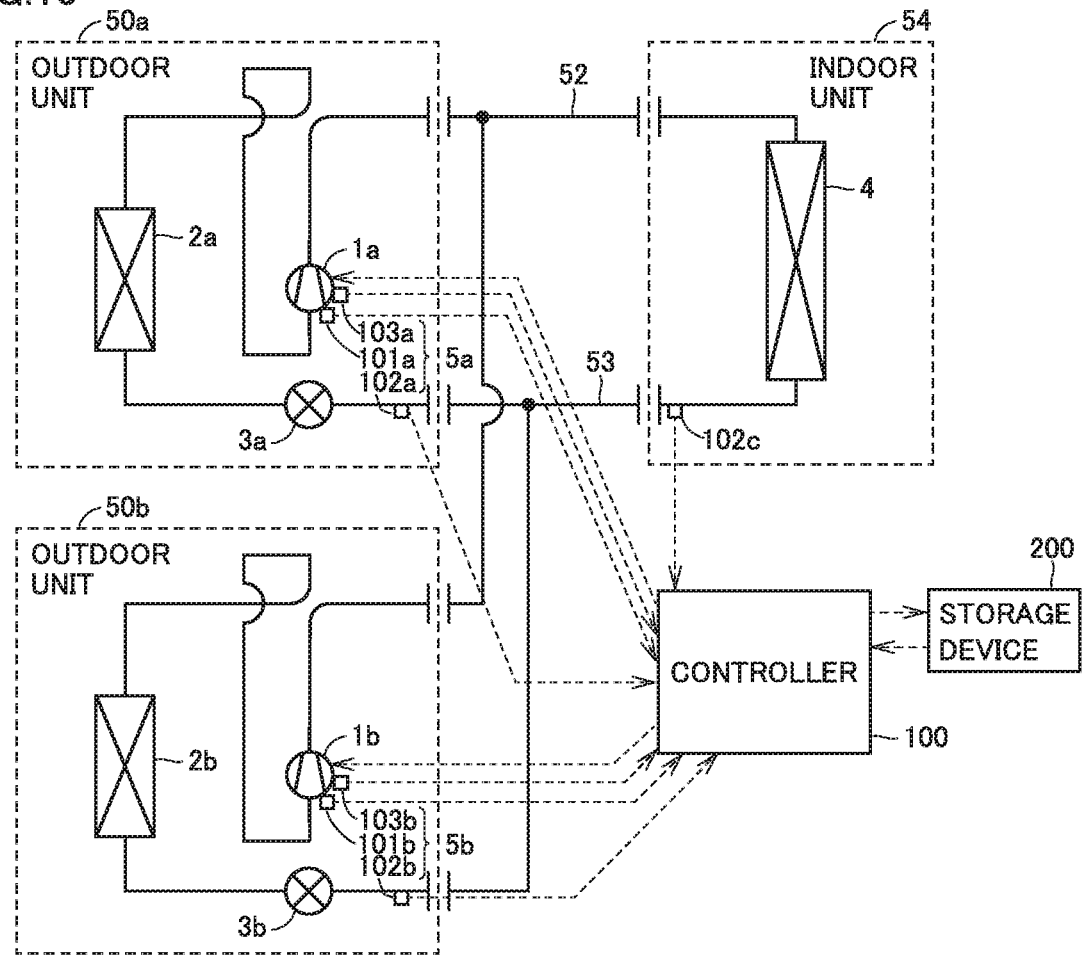
FIG. 15 is a general configuration diagram of a refrigeration cycle apparatus in embodiment 3.

FIG. 15 is a general configuration diagram of a refrigeration cycle apparatus in embodiment 3. With reference to FIG. 15, the refrigeration cycle apparatus in embodiment 3 includes density detectors 103*a*, 103*b* to detect the oil densities in compressors 1*a*, 1*b*, respectively, in addition to the configuration of the refrigeration cycle apparatus in embodiment 2 shown in FIG. 8. In embodiment 3, sensors 5*a*, 5*b* respectively include density detectors 103*a*, 103*b* provided on compressors 1*a*, 1*b* of outdoor units 50*a*, 50*b* to detect the densities of refrigeration oil. The configuration of the other parts is the same as that of the refrigeration cycle apparatus of FIG. 8. In embodiment 3, controller 100 controls the quantities of discharge from compressors 1*a*, 1*b* in accordance with the outputs of density detectors 103*a*, 103*b*. Controller 100 calculates the conversion value of oil quantity in each compressor based on the detection values of the liquid level and the oil density. Controller 100 controls the operation frequency of the compressor in accordance with the calculated oil quantity in the compressor.

Density detector 103*a*, 103*b* to detect the oil density in each compressor 1*a*, 1*b* may be an optical sensor to detect the change in intensity of transmitted light through the refrigeration oil. Other examples of the density detector to be used include a capacitance sensor to detect the change in capacitance between electrodes, and an ultrasonic sensor to generate an ultrasonic wave and detect the change in sound velocity.

Alternatively, a temperature sensor may be used to detect the temperature, and the oil density may be calculated based on the temperature. Since there is a density curve with respect to the temperature and the pressure according to the types of refrigerant and refrigeration oil, the oil density can be estimated from calculation from the relation.

Figure 16:
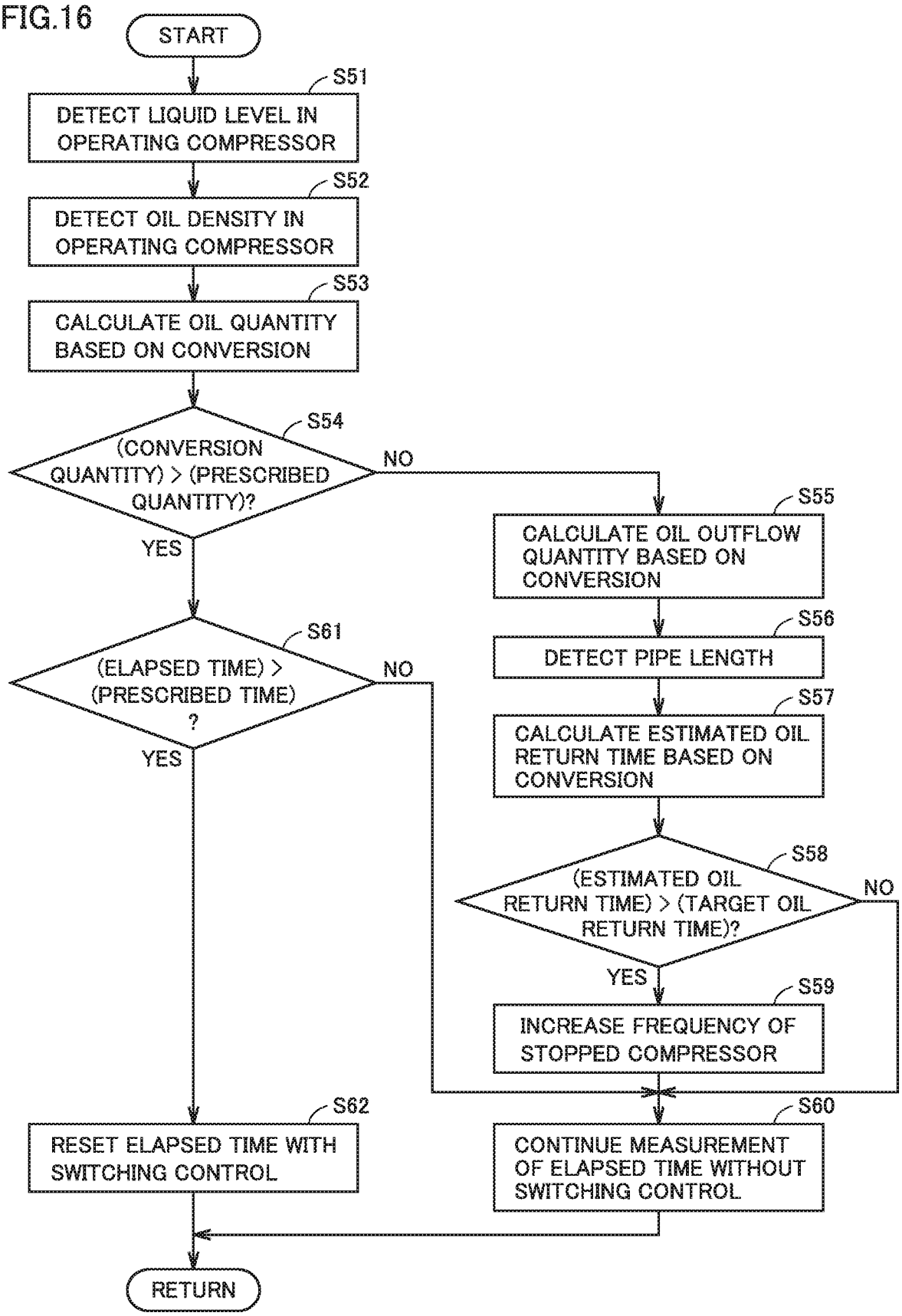
FIG. 16 is a flowchart for explaining the control during the single-outdoor-unit operation to be executed by a controller in embodiment 3.

FIG. 16 is a flowchart for explaining the control during the single-outdoor-unit operation to be executed by the controller in embodiment 3.

With reference to FIG. 16, first, the liquid level in an operating compressor is detected at step S51. At step S52, the oil density in the operating compressor is detected. At step S53, controller 100 calculates the oil quantity in the operating compressor based on the conversion of the liquid level and the oil density.

From the liquid level, the liquid quantity in the compressor can be estimated. If the refrigeration oil is uniformly dissolved in the liquid refrigerant, the value calculated by multiplying the liquid quantity by the oil density is the oil quantity. Therefore, the oil density can be estimated using the liquid level and the graph in FIG. 9, and the oil density can be converted into the oil quantity.

If the operating compressor is compressor 1*a*, the refrigerant and refrigeration oil circulate through the refrigerant circuit as indicated by the solid line arrows in FIG. 11. When the refrigerant and refrigeration oil are released from compressor 1*a*, the released refrigerant and refrigeration oil pass through pipe 52, indoor heat exchanger 4, and pipe 53, and return to compressor 1*a*. At this time, if a large quantity of refrigeration oil temporarily stays in the elements of the refrigerant circuit, the inflow quantity to compressor 1*a* is decreased. The decrease in inflow quantity causes decreases in liquid level and oil quantity in compressor 1*a*.

At step S54, controller 100 determines whether or not the oil conversion quantity in the compressor is larger than a prescribed quantity. If (oil conversion quantity)>(prescribed quantity) is not satisfied (NO at S54), controller 100 does not perform the switching control. Controller 100 releases the refrigerant and refrigeration oil from compressor 1*a* so that estimated oil return time T is equal to or shorter than target oil return time T*. Specifically, if (detected position)>(prescribed position) is not satisfied at step S54 (NO at S54), controller 100 calculates the oil outflow quantity from the compressor based on the conversion of the liquid level and the frequency of the compressor, as shown in FIG. 9 (S55), and calculates pipe length La of pipes 52, 53 from the outputs of position detectors 102*a*, 102*b*, 102*c* (S56). After that, the process of calculating estimated oil return time T is executed based on the above-described formula (1) (S57).

At step S58, if (estimated oil return time T)>(target oil return time T*) is satisfied, stopped compressor 1*b* is brought into operation and is increased in operation frequency (S59). In this case, as shown in FIG. 12, the circulation of refrigerant and refrigeration oil indicated by the broken line arrows is started, in addition to the circulation of refrigerant and refrigeration oil indicated by the solid line arrows. Thus, when the liquid level of refrigeration oil in the operating compressor temporarily becomes lower than the prescribed position, the lowered liquid level is expected to recover to equal to or higher than the prescribed position at an early stage because of the additional refrigeration oil discharged to pipe 52 from the compressor that has been stopped.

The refrigeration oil released from compressor 1*a* (and compressor 1*b*) passes through the elements of the refrigerant circuit and flows in compressors 1*a* and 1*b* (S60). If the condition is not satisfied at S61 or S58, the process goes on to S60, where the measurement of the elapsed time is continued without performing the switching control.

After that, the process from S51 is executed again. If the conversion quantity of the refrigeration oil in compressor 1*a* is larger than the prescribed quantity (YES at S54) and the elapsed time from the switching has exceeded the prescribed time (YES at S61), then controller 100 switches the compressor to operate from compressor 1*a* to compressor 1*b*. At this time, the refrigeration oil that has been released in pipes 52, 53 and indoor heat exchanger 4 flows into compressor 1*b*. Specifically, if (conversion quantity)>(prescribed quantity) is satisfied (YES at S54) and (elapsed time)>(prescribed time) is satisfied (YES at S61), then the switching control is started and the count of elapsed time is reset (S62). After the process of step S62 is executed, the operating compressor is switched from compressor 1*a* to compressor 1*b*.

Accordingly, the flow is changed so that the refrigerant and refrigeration oil circulate through the refrigerant circuit as indicated by the solid line arrows in FIG. 13. Although the operation switching from compressor 1*a* to compressor 1*b* has been described above, the switching from compressor 1*b* to compressor 1*a* can be performed by a similar process.

Figure 17:
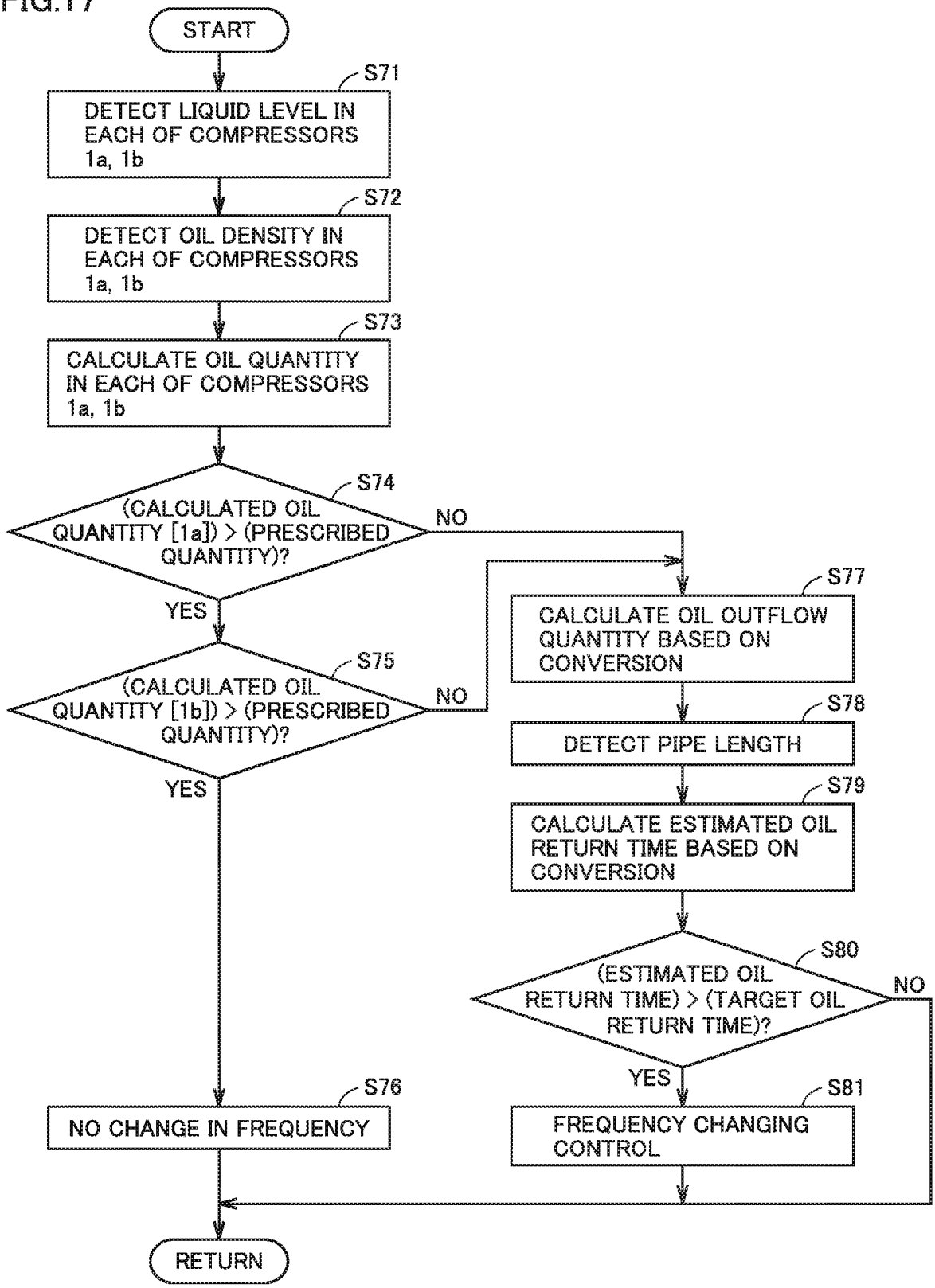
FIG. 17 is a flowchart for explaining the control during the multi-outdoor-unit operation to be executed by the controller in embodiment 3.

FIG. 17 is a flowchart for explaining the control during the multi-outdoor-unit operation to be executed by the controller in embodiment 3. During the multi-outdoor-unit operation, compressors 1*a*, 1*b* are both operating. With reference to FIG. 17, at step S71, the liquid levels in operating compressors 1*a*, 1*b* are detected. At step S72, the oil densities in compressors 1*a*, 1*b* are detected. At step S73, controller 100 calculates the oil quantities of operating compressors 1*a*, 1*b* based on the conversion of the liquid levels and the oil densities.

Then, controller 100 determines whether or not the oil quantity in compressor 1*a* is larger than a prescribed quantity (YES at S74), or whether or not the oil quantity in compressor 1*b* is larger than a prescribed quantity (S75).

If the oil quantities of the refrigeration oil in compressors 1*a*, 1*b* are both larger than the prescribed quantity (YES at S74 and S75), the process goes on to step S76, where the operation frequencies of compressors 1*a*, 1*b* are maintained at the current levels with no change in frequency (S76).

On the other hand, if the oil quantity of the refrigeration oil in any one of compressors 1*a*, 1*b* is equal to or smaller than the prescribed quantity (NO at S74 or S75), the processes of steps S77, S78, S79, S80 are sequentially performed. The processes of steps S77, S78, S79, S80 are respectively the same as the processes of S23, S24, S25, S26 in FIG. 10, and thus the explanation thereof is not repeated.

At step S80, if (estimated oil return time T)>(target oil return time T*) is satisfied, controller 100 executes frequency changing control at step S81. In the frequency changing control, if the liquid level in compressor 1*a* is equal to or lower than the prescribed position for example, the frequency is controlled so that estimated oil return time T is equal to or shorter than the target estimated time. In this case, controller 100 increases the discharging flow rate of compressor 1*a* (high flow rate) to increase the inflow quantity of refrigeration oil. In accordance with the increase in discharging flow rate of compressor 1*a*, controller 100 decreases the discharging flow rate of compressor 1*b* (low flow rate) to decrease the inflow quantity of refrigeration oil to compressor 1*b*, so that the indoor flow rate is constant.

A refrigeration cycle apparatus including multiple outdoor units may cause depletion of oil not only due to a decrease in liquid level, but also due to a decrease in oil density, such as an excessive liquid back condition. This may result in deterioration in reliability. The liquid back easily occurs when a compressor is activated, when the operation is switched to the heating operation after the completion of the defrosting operation, and when the connection pipes are short and thus have surplus refrigerant, for example. However, the refrigeration cycle apparatus in embodiment 3 as described above can avoid depletion of oil in all conditions and thus improves in reliability by detecting a decrease in oil quantity caused by decreases in liquid level and oil density.

Embodiment 4

The general configuration of a refrigeration cycle apparatus in embodiment 4 is the same as that of embodiment 3 shown in FIG. 15, and the explanation thereof is not repeated.

Embodiment 4 is characterized in that correction is made to estimated oil return time T and target oil return time T* which are used in steps S58 and S80 in the control executed in embodiment 3 shown in FIG. 16 and FIG. 17.

In embodiment 3, estimated oil return time T is calculated based on the above-described formula (1). Further, in embodiment 3, target oil return time T* is a predetermined value stored in storage device 200.

In contrast, in embodiment 4, if the oil quantity in compressor 1*a*, 1*b* is decreased to smaller than a prescribed quantity, then controller 100 measures the recovery time required for the decreased oil quantity to recover to the prescribed quantity, and corrects the oil return time based on the recovery time. Specifically, the above-described target oil return time T* is corrected based on the oil quantity recovery time. For example, if the oil quantity is increased after target oil return time T* is reached, target oil return time T* is increased; whereas if the oil quantity is increased before target oil return time T* is reached, target oil return time T* is decreased.

Further, in embodiment 4, estimated oil return time T is corrected. For example, the oil return flow rate is calculated based on the conversion of the oil quantity recovery time and the quantity of change, and estimated oil return time T is corrected in accordance with the oil return flow rate.

If there is an estimation error between estimated oil return time T and the actual oil return time, an operation (learning operation) to correct the error is performed. If the estimation error occurs, the first estimated oil return time T (referred to as estimated oil return time T0) and the second estimated oil return time T are different from each other. The second estimated oil return time T is calculated by calculating correction factor η from estimated oil return time T0 and the estimation error, and by multiplying estimated oil return time T that has been calculated in the same way as estimated oil return time T0, by correction factor η. This aims to make the estimation error smaller and smaller by applying estimated oil return time T learned by correction factor η.

The method of the correction is described hereinafter in more detail. First, the oil quantity in the compressor is calculated based on the conversion of the liquid level and the oil density (the same as S51 to S53 in FIG. 16). If the oil quantity is decreased to smaller than a predetermined quantity, the quantity of change ΔM, which is the difference between the detected oil quantity and the prescribed quantity, is detected. Also, the time (oil quantity recovery time) ΔT required for the oil quantity to reach the prescribed quantity thereafter is detected.

At this time, oil return flow rate Gr(oil) is calculated by Gr(oil)=ΔM/ΔT, and correction factor η is calculated by η=(Gr(oil)/ΔM)/T0, where T0 denotes estimated oil return time T which was calculated in the above-described formula (1) before the decrease in oil quantity.

Target oil return time T* and estimated oil return time T are corrected in accordance with the correction factor as shown in the following formulae (3), (4), and they can be applied to step S58 in FIG. 16 and step S80 in FIG. 17.

$$T^*=\Delta T \tag{3}$$

$$T=Va/[\{(Gra\times\varphi a)+(Grb\times\varphi b)\}\times\{Gra/(Gra+Grb)\}]\times\eta \tag{4}$$

Target oil return time T*, estimated oil return time T, and correction factor η are stored in storage device 200. Controller 100 controls each compressor in accordance with target oil return time T* and estimated oil return time T, which have been corrected, and in accordance with the detected liquid level.

In embodiment 4, target oil return time T* and estimated oil return time T are corrected in accordance with the operation condition, the environmental condition, and the installation condition, by detecting the oil quantity recovery time and the quantity of change. This can prevent depletion of oil and improve the reliability with minimum power consumption.

Embodiment 5

In embodiment 5, one of a plurality of outdoor units is used to estimate the oil quantity in the compressor of the other outdoor unit(s).

The refrigeration cycle apparatus in embodiment 5 is a refrigeration cycle apparatus in which at least one outdoor unit has the same configuration as the outdoor unit in embodiments 1 to 4. Similar to the method shown in embodiments 1 to 4, the oil quantity in the compressor of a part of the outdoor units is calculated based on the conversion using an oil quantity detecting means (a liquid level detector or a density detector), and the quantity of staying oil in the circuit is calculated based on the conversion using a staying quantity detecting means. The oil quantity in the remaining compressor(s) is estimated from the oil quantity in the compressor and the quantity of staying oil.

When the oil quantity in the compressor of a part of the outdoor units and the oil quantity in the refrigerant circuit are known, the oil quantity in the compressor of the other outdoor unit(s) can be estimated from the sealed oil quantity (total quantity). For example, if the apparatus includes a master outdoor unit and a slave outdoor unit, only the master outdoor unit may have a means to detect the oil quantity, with no need for the slave outdoor unit to have a means to detect the oil quantity. The remaining oil quantity can be estimated on the assumption that the remaining oil is in the compressor of the other outdoor unit.

If connected in parallel to a type of apparatus with no oil quantity sensor for compressor, the refrigeration cycle apparatus in embodiment 5 can estimate the oil quantity in each compressor, thus avoiding depletion of oil in each compressor and improving the reliability.

In the embodiments described above, an oil quantity sensor is provided for each compressor to detect or estimate the oil quantity of the outdoor unit. However, if the indoor unit includes an oil separator and/or an accumulator, oil quantity sensors may be provided for these components, so that the oil quantity in the outdoor units may be detected including the oil quantities in these components.

It should be understood that the embodiments disclosed herein are by way of example in every respect and without limitation. The scope of the present invention is defined not by the above description of the embodiments but by the terms of the claims, and is intended to include any modification within the meaning and scope equivalent to the terms of the claims.

The invention claimed is:

1. A refrigeration cycle apparatus comprising:

an indoor unit comprising at least an indoor heat exchanger;

a plurality of outdoor units connected in parallel to each other and connected to the indoor unit; and a controller configured to control the plurality of outdoor units, each of the plurality of outdoor units including an outdoor heat exchanger, a compressor, and a sensor configured to detect a quantity of refrigeration oil in the compressor, the refrigeration cycle apparatus further comprising at least one expansion device, the indoor heat exchanger, the expansion device, the outdoor heat exchanger, and the compressor constituting a refrigerant circuit through which refrigerant circulates, as an operation mode, the controller having a first operation mode in which the compressors in a part of the plurality of outdoor units is operated and the compressor in another outdoor unit is stopped, and a second operation mode in which the compressors in all of the plurality of outdoor units are operated, in the first operation mode, when the quantity of refrigeration oil in a compressor of an operating outdoor unit is smaller than or equal to a prescribed quantity, the controller being configured to maintain operation of the compressor in the operating outdoor unit without stopping the compressor in the operating outdoor unit, in the first operation mode, when the quantity of refrigeration oil in the compressor of the operating outdoor unit is larger than the prescribed quantity and when an operating time of the operating outdoor unit exceeds a prescribed time, the controller being configured to stop the compressor in the operating outdoor unit and make a switch to bring the compressor in a stopped outdoor unit of the plurality of outdoor units into operation.

2. The refrigeration cycle apparatus according to claim 1, wherein in the second operation mode, when the quantity of refrigeration oil in the compressor of a first outdoor unit of the plurality of outdoor units is smaller than the prescribed quantity, the controller is configured to control the plurality of outdoor units so as to increase a discharging refrigerant flow rate of the compressor of the first outdoor unit and so as to decrease a discharging refrigerant flow rate of the compressor of a second outdoor unit of the plurality of outdoor units.

3. The refrigeration cycle apparatus according to claim 1, wherein the sensor comprises a liquid level detector provided on the compressor of each of the plurality of outdoor units and configured to detect a liquid level of refrigeration oil, and the controller is configured to control a quantity of discharge from the compressor in accordance with an output of the liquid level detector.

4. The refrigeration cycle apparatus according to claim 1, wherein the plurality of sensors each comprise a position detector configured to detect a position of a corresponding one of the plurality of outdoor units, the controller is configured to calculate the length of the refrigerant pipe using an output of at least one of the position detectors from one or more of the plurality of outdoor units, and calculate, using the calculated length of the refrigerant pipe, an oil return time required for refrigeration oil discharged from the compressor to return to the compressor, and the controller is configured to control a quantity of discharge from the compressor based on the oil return time.

5. The refrigeration cycle apparatus according to claim 4, wherein when an oil quantity in the compressor is decreased to smaller than a prescribed quantity, the controller is configured to measure a recovery time required for the decreased oil quantity to recover to the prescribed quantity, and correct the oil return time based on the recovery time.

6. The refrigeration cycle apparatus according to claim 1, wherein the sensor comprises a density detector provided on the compressor of each of the plurality of outdoor units and configured to detect a density of refrigeration oil, and the controller is configured to control a quantity of discharge from the compressor in accordance with an output of the density detector.

7. The refrigeration cycle apparatus according to claim 2, wherein the sensor comprises a liquid level detector provided on the compressor of each of the plurality of outdoor units and configured to detect a liquid level of refrigeration oil, and the controller is configured to control a quantity of discharge from the compressor in accordance with an output of the liquid level detector.

8. The refrigeration cycle apparatus according to claim 2, wherein the plurality of sensors each comprise a position detector configured to detect a position of a corresponding one of the plurality of outdoor units, the controller is configured to calculate the length of the refrigerant pipe using an output of at least one of the position detectors from one or more of the plurality of outdoor units, and calculate, using the calculated length of the refrigerant pipe, an oil return time required for refrigeration oil discharged from the compressor to return to the compressor, and the controller is configured to control a quantity of discharge from the compressor based on the oil return time.

9. The refrigeration cycle apparatus according to claim 2, wherein the sensor comprises a density detector provided on the compressor of each of the plurality of outdoor units and configured to detect a density of refrigeration oil, and the controller is configured to control a quantity of discharge from the compressor in accordance with an output of the density detector.

* * * * *